US007281790B2

(12) United States Patent
Mouri et al.

(10) Patent No.: US 7,281,790 B2
(45) Date of Patent: Oct. 16, 2007

(54) INK-JET RECORDING METHOD AND INK-JET RECORDING APPARATUS

(75) Inventors: Akihiro Mouri, Tokyo (JP); Hiroshi Taniuchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 292 days.

(21) Appl. No.: 10/986,911

(22) Filed: Nov. 15, 2004

(65) Prior Publication Data

US 2005/0110856 A1 May 26, 2005

(30) Foreign Application Priority Data

Nov. 20, 2003 (JP) ..... 2003-391485
Oct. 21, 2004 (JP) ..... 2004-307229

(51) Int. Cl.
*B41J 2/01* (2006.01)

(52) U.S. Cl. ..... 347/103; 347/102

(58) Field of Classification Search ..... 347/103, 347/101, 102
See application file for complete search history.

(56) References Cited

U.S. PATENT DOCUMENTS

| | | | | |
|---|---|---|---|---|
| 4,538,156 A | | 8/1985 | Durkee et al. | 346/21 |
| 5,099,256 A | | 3/1992 | Anderson | 346/1.1 |
| 5,372,852 A | * | 12/1994 | Titterington et al. | 427/288 |
| 5,841,456 A | | 11/1998 | Takei et al. | 347/103 |
| 6,059,407 A | | 5/2000 | Komatsu et al. | 347/103 |
| 6,257,716 B1 | | 7/2001 | Yanagawa et al. | 347/102 |
| 6,402,317 B2 | | 6/2002 | Yanagawa et al. | 347/104 |
| 6,540,344 B2 | | 4/2003 | Kashiwazaki et al. | 347/100 |
| 6,860,593 B2 | | 3/2005 | Kashiwazaki et al. | 347/100 |
| 7,055,946 B2 | * | 6/2006 | Bejat et al. | 347/103 |
| 2001/0038409 A1 | | 11/2001 | Yanagawa et al. | 347/104 |

FOREIGN PATENT DOCUMENTS

| | | | |
|---|---|---|---|
| JP | 62035848 A | * | 2/1987 |
| JP | 62-92849 | | 4/1987 |
| JP | 1-146750 | | 6/1989 |
| JP | 5-200999 | | 8/1993 |
| JP | 7-89067 | | 4/1995 |
| JP | 7-256873 | | 10/1995 |
| JP | 11-188858 | | 7/1999 |

* cited by examiner

*Primary Examiner*—Stephen Meier
*Assistant Examiner*—Ly T. Tran
(74) *Attorney, Agent, or Firm*—Fitzpatrick, Cella, Harper & Scinto

(57) ABSTRACT

An ink-jet recording method and an ink-jet recording apparatus, wherein ink image with high quality and good abrasion resistance without generation of beading and bleeding are formed on recording media, in ink-jet recording using an intermediate transfer body, are provided. An ink image is formed by applying an image fixing component (for example reacting liquid) to an intermediate transfer body, and then applying inks of colors, Y, M, C, and K, from print heads corresponding each color. Then a supplementary liquid is applied to the ink image, and the ink image is transferred to a recording media.

13 Claims, 5 Drawing Sheets

INK-JET RECORDING METHOD AND INK-JET RECORDING APPARATUS

BACKGROUND OF THE INVENTION

1. Field of the Invention

The present invention relates to an ink-jet recording method and an ink-jet recording apparatus, and more precisely relates to an ink-jet recording method and an ink-jet recording apparatus for recording by forming an ink image on an intermediate transfer body, and transferring the ink image to an recording medium.

2. Description of the Related Art

The ink-jet recording system, electrophotographic system, thermal head system, dot impact system and the like are currently utilized as recording systems for image recording apparatuses that record and output in response to the request of users the images made by computers, duplicate images of printed matters, and facsimile images.

Among the systems, the ink-jet recording system is a quiet printing system that prints letters and images by directly ejecting the ink onto materials for printing (recording media) such as paper, cloth, plastic sheets, etc. in response to image signals. Since this system does not require any complicated apparatus, its running cost is low and it is easily downsized and colorized. The system is further variously advantageous, for example, in flexibility towards size of recording media from card size to large poster size. In terms of quality of images also, output of images with quality as high as that of silver salt color photographs has become possible in recent years. Since recording apparatuses utilizing the ink-jet system are advantageous as described above, they are used not only for printers as output apparatuses connected to personal computers but also as output apparatuses for office automation machines such as facsimiles and copy machines. Further, the systems are also widely used in the field of industrial production for printing various cards, packages and large-size posters.

As a recent trend in various fields, there is a demand for outputting high quality images by means of ink-jet recording system regardless of kinds of recording media. In order to meet such a demand, especially in these cases, factors or phenomena such as "feathering", "beading", and "bleeding" that cause deterioration of images on recording media as described later need to be controlled. These phenomena have become more pronounced as ink-jet recording becomes faster.

The above-mentioned phenomena that cause deterioration of images are closely related with characteristics of recording media and properties of inks for recording. In the case of forming images on recording media formed with cellulosic fiber, such as regular paper (PPC), by ejecting inks, for example, "feathering" phenomenon or exudation of ink along the fiber comprising the recording media unless the inks or the recording media are provided with any chemical treatment. In the case of forming images on non-absorbing recording media comprised of plastic sheets such as PET (polyethylene terephthalate) and polyethylene that reject infiltration of solvents, or on gloss printing paper that allow only a little infiltration of inks, a phenomenon called "repelling" occurs in which inks ejected onto the recording media are not completely absorbed and flow. At the same time, the ink dots that are formed on the recording media gather together and neighboring ink dots get mixed, resulting in the phenomenon of "beading". Further, overlapped colors exude to each other at their boundary, resulting in the phenomenon of "bleeding" and deterioration of quality of image formation. Therefore, it has been difficult to form good images on regular paper or non-absorbing recording media by means of an ink-jet recording system.

As the method for solving the above-mentioned problems, ink-jet recording using inks that are made to fit various recording media by changing solvents in ink compositions or causing liquid-solid phase changes is known. Here, the main solvents of recording inks are classified as oil-based, organic solvent-based and water-based solvents. Generally, when oil-based and organic solvent-based inks are used, the apparatuses need to be provided with exhaust and recovery systems to avoid odor and influence to environment and human bodies, resulting in the problem that the apparatuses become larger. Further, rapid evaporation of the solvents tends to cause clogging of nozzles of the print head which are ejection port. Therefore, it is not advantageous to use oil-based and organic solvent-based inks for recording. Water-based inks, on the other hand, do not require consideration of influence to environment and human bodies in conformation of apparatuses, since tasteless, odorless, and colorless water is used as the solvent. Also, water-based inks are free from clogging of nozzles by inks and are widely used.

There is a recording system called a hot melt ink-jet system that utilizes liquid-solid phase change. When this system is used, the inks are heated to become less viscous and either ejected directly onto recording media or ejected onto heated intermediate transfer body for formation of ink images. The ink images are then transferred from the transfer body to recording media to form images. In either case, the inks are solidified by spontaneous cooling on recording media to form images. Such a hot melt system has an advantage that recording on any recording media is possible.

This system, however, requires exertion of liquid-solid phase change characteristics of inks. This results in increase in amounts of resin which shows liquid-solid phase change characteristics much more than colorants, and requires large amount of inks on recording media in order to obtain desired optical concentration. As a result, there has been a problem of deterioration of quality of images due to thickness of inks deposited on the recording media. Further, since solid inks need to be once melted to make liquid, it is necessary to keep the ink supply routes and print heads heated during operation of the apparatus and to always maintain the ink onto liquid states, causing consumption of enormous amount of energy. The system is not useful from the view point of energy saving either.

Many of other known recording systems that intend to solve the above-mentioned problems propose so-called transfer systems that once form ink images on an intermediate transfer body by means of an ink-jet recording system, increase the viscosity of the ink images on the intermediate transfer body through drying of the ink or remove of the solvent from the ink images to concentrate the ink, and then transfer the ink images from the intermediate transfer body to the recording media (U.S. Pat. No. 4,538,156, U.S. Pat. No. 5,099,256, and Japanese Patent Application Laid-open No. 62-092849(1987)). The recording methods of these transfer systems are not methods of forming images on recording media through infiltration of water in the ink into the recording media as in the conventional ink-jet recording systems. Therefore, they are effective means especially for preventing feathering phenomenon in which inks spread along fibers of a recording media while the inks infiltrate into the recording media. Further, it is possible to control amounts of water and solvents of the inks for forming ink images on the intermediate transfer body, and control its viscosity in accordance with an ink infiltration characteristic when the ink images formed are transferred from the intermediate transfer body to recording media. Thus, flexibility of usable recording media is increased. Further, use of an intermediate transfer body in ink-jet recording separates the print head having the nozzles for ejecting inks from the recording media. Therefore, there are various advantages such as preventing clogging of the print head through deposition of paper powder from recording media on the nozzles.

In order to obtain higher quality images by means of ink-jet recording systems utilizing an intermediate transfer body, however, it is desirable to satisfy the conditions described in the following [1] through [4].

[1] The ink images on the intermediate transfer body are formed as images without beading and bleeding.

[2] The ink images formed on the intermediate transfer body is transferred to the recording media without deterioration of the images.

[3] The transferred ink images are free from offset when dried, fixed and piled, and have abrasion resistance.

[4] The intermediate transfer body is easily cleanable after transfer, and able to repeat forming images.

However, the following problems have arisen about the above-mentioned item. Concerning [1], since the intermediate transfer body used is not a recording medium that allow infiltration of ink solvents, beading by which the neighboring ink dots ejected onto the intermediate transfer body stick with one another to unduly diffuse or flow, and positions or shapes of the dots are significantly changed occurs damaging the images. Then, transferred images naturally become damaged so that eventually high quality images cannot be formed on the recording media.

Concerning [2], when the ink images formed on the intermediate transfer body are transferred to the recording media, local failure in transfer of portions of the ink images or generating state in which ink images dissociate inside and the dissociated ink images are transferred the intermediate transfer body and the recording media respectively causes irregulars coloration or optical concentration of the images on the recording media, and good images cannot be formed.

Concerning [3], when the amount of resin is too small in the ratio between colorant and resin that are solid components of ink images transferred to recording media such as printing paper, or when a nonvolatile solvent component other than water, such as organic solvent, remains in ink images even if there is enough amount of resin, cohesive force of the solid components of the inks that form ink images becomes weak. This causes offset ink smear when recording media are piled, or ink smear through abrasion.

Concerning [4], when a large amount of inks forming ink images on the intermediate transfer body remains on the intermediate transfer body after transfer, it gives a tremendous load on cleaning. This not only results in problems such as reduction of recording speed and energy consumption due to cleaning, but also causes problems such as generation of a large amount of waste inks and that apparatuses become larger.

In order to solve the problems, Japanese Patent Application Laid-open No. 5-200999(1993) discloses an apparatus which emits ink dots from an ink-jet print head onto an intermediate transfer body, concentrates the ink by making the intermediate transfer body absorb the solvent in the inks, and transfers the inks to a recording media. The apparatus is one of the useful means that enable formation of good images.

The apparatus disclosed by the Japanese Patent Application Laid-open No. 5-200999(1993), however, has a unique problem that efficiency of transfer to recording media is reduced due to clogging of solvent absorption holes of the intermediate transfer body. It makes the cleaning of residual inks on the intermediate transfer body a big deal. Moreover, there is also a problem of much energy consumption in recovering initial condition of the transfer body by removing the solvent absorbed in the intermediate transfer body by air suction and discharging absorbed water by heating.

Japanese Patent Application Laid-open No. 11-188858 (1999) proposes a method and an apparatus that first form powder soluble to or swellable with inks on an intermediate transfer body, form images by emitting ink drops from an ink-jet print head onto the transfer body, and then transfer the images from the intermediate transfer body to recording media.

The method disclosed by the Japanese Patent Application Laid-open No. 11-188858(1999), however, consumes much energy in removal of water taken in by the powder that is capable of absorption of water. When images still containing water are transferred to recording media, the water absorbed by the recording media expands the images, damages sharpness of the images, and reduces optical concentration, causing deterioration of the images. In imageless portions of the intermediate transfer body where no image is formed, there remains uncolored water absorbing resin powder. It may cause stain on the recording media during transfer and further deterioration of the quality of images. The image forming method utilizing the above-mentioned process is useful as a method for fixing images on an intermediate transfer body. In the image forming method, however, in order to stably supply the transfer body with powder again after transfer, a process of recoating powder is required after cleaning of the powder in imageless portions on the transfer body. The apparatuses for cleaning the intermediate transfer body and powder coating take much space.

Japanese Patent Application Laid-open No. 1-146750 (1989), on the other hand, discloses an apparatus that forms a thin film of glycerin capable of releasing oil-based inks on an intermediate transfer body, whereon ink images are formed with oil-based inks. Thus, use of oil-based inks as inks for forming images on recording media enables formation of good ink images on the intermediate transfer body.

The apparatus disclosed by the Japanese Patent Application Laid-open No. 1-146750(1989) can provide images with high quality and good water resistance when oil-based inks are used as described above. The oil-based inks described above, however, may adversely influence human bodies and environment, since they contain organic solvents that are harmful to human bodies and environment. When the method is carried out using water-based ink compositions taking influence on human bodies and environment into consideration, beading and bleeding occur due to good affinity of the water-based inks with the glycerin film formed on the intermediate transfer body, and images formed are distorted. There is another problem that rapid fixing is impossible due to slow drying.

Further, Japanese Patent Application Laid-open Nos. 7-089067(1995) and 7-256873(1995) disclose methods for carrying out ink-jet recording by coating surfactants in advance on an intermediate transfer body with releasing property to provide it with increased wettability for water-based inks. These methods solve the problem of exudation of inks on recording media by forming images with water-based inks on an intermediate transfer body which is coated with a surfactant in advance, and transferring them to recording media when appropriate viscosity is attained.

The methods for solving problems in ink-jet recording using an intermediate transfer body disclosed by the Japanese Patent Application Laid-open Nos. 7-089067(1995) and 7-256873(1995) are useful when images are formed on an intermediate transfer body or recording media using an ink of a single color, such as a black ink of same concentration, alone. They are not decisive solutions, however, in case colored high quality images are formed by ejecting inks with different concentrations and colors from plurality of different nozzles onto predetermined image address points on recording media.

It is clear as described above that there still remain problems to be improved, although various methods have been proposed for carrying out formation of good images on regular paper and non-absorbing recording media, when image formation is carried out by means of an ink-jet recording system utilizing an intermediate transfer body. In particular, a demand for rear face printing of a printed sheet immediately after rapid record output, or a demand for implementation of book binding, namely cutting and folding, of recording media immediately after output have been raised. Therefore, further improvement is required in rapid drying and fixing of ink images transferred from an intermediate transfer body to recording media, and in complete fixing with good abrasion resistance.

In order to solve such problems, methods of increasing materials for reducing flowability of color inks (also called "image fixing components" in this specification) and the amount of such additives as high molecular weight resins in inks can be considered. Excessive addition of additives to inks, however, has been possible to cause deterioration of stability of ink discharge from an ink-jet print head, and reduction of stability of means of coating due to retention of resin in the means of coating due to drying of image fixing components.

SUMMARY OF THE INVENTION

The purpose of the present invention is to provide a method and an apparatus for ink-jet recording wherein ink images with high quality and good abrasion resistance (fixability) without beading and bleeding are formed on recording media in ink-jet recording utilizing an intermediate transfer body.

In the first aspect of the present invention, there is provided an ink-jet recording method comprising the steps of:

applying a first material that reduces flowability of ink having colorants, to an intermediate transfer body;

forming ink image on the intermediate transfer body by applying the ink from print head to the intermediate transfer body to which the first material has been applied;

transferring the ink images formed on the intermediate transfer body to a recording media; and applying a second material to improve abrasion resistance of images on the recording media to the intermediate transfer body before the transfer step.

In the second aspect of the present invention, there is provided an ink-jet recording method comprising the steps of:

applying a first material for making colorants of ink coagulate, to an intermediate transfer body;

forming ink image on the intermediate transfer body by applying the ink from print head to the intermediate transfer body to which the first material has been applied;

transferring the ink images formed on the intermediate transfer body to a recording media; and applying a second material having resin to the intermediate transfer body before the transfer step.

In the third aspect of the present invention, there is provided an ink-jet recording apparatus comprising:

a first application means for applying a first material that reduces reducing flowability of ink having colorants, to an intermediate transfer body;

a formation means for forming ink image on the intermediate transfer body by applying the ink from print head to the intermediate transfer body to which the first material has been applied;

a transfer means for transferring the ink images formed on the intermediate transfer body to a recording media; and a second application means for applying a second material to improve abrasion resistance of images on the recording media to the intermediate transfer body before the ink image is transferred by the transfer means.

In the fourth aspect of the present invention, there is provided an ink-jet recording apparatus comprising:

a first application portion that applies a first material for rendering colorants of ink coagulate, to an intermediate transfer body;

a formation portion that forms ink image on the intermediate transfer body by applying the ink from print head to the intermediate transfer body to which the first material has been applied;

a transfer portion that transfers the ink image formed on the intermediate transfer body to a recording media; and a second application portion that applies a second material having resin to the intermediate transfer body before the ink image is transferred by the transfer portion.

The image fixing component to be described below is preferably used as the above-mentioned "first material", and the supplementary liquid to be described below is preferably used as the above-mentioned "second material".

Further, not only paper used with ordinary recording apparatuses but also widely cloths, plastic films, etc. capable of accepting inks is the "recording media" of the present invention.

According to an embodiment of the present invention, the intermediate transfer body is applied, besides coloring inks, a first material (an image fixing component) for reducing flowability of the coloring inks and a second material (a supplementary liquid) for improving abrasion resistance of images on recording media after transfer. Thus, ink images free from beading or bleeding can be formed on the intermediate transfer body, and by transferring the ink images to recording media, high quality images can be formed on the recording media. Moreover, since ink images containing the above-mentioned second material are transferred on the intermediate transfer body, the images after transfer on the recording media have good abrasion resistance (fixability).

The above and other objects, effects, features and advantages of the present invention will become more apparent from the following description of embodiments thereof taken in conjunction with the accompanying drawings.

DETAILED DESCRIPTION OF PREFERRED EMBODIMENTS

The embodiments of the present invention will be precisely described below with reference to drawings.

First Embodiment

This embodiment applies a supplementary liquid to ink images formed on a transfer drum 1, after the transfer drum 1, i.e. an intermediate transfer body, is applied the inks of each color at an ink applying portion 3, by arranging a supplementary liquid applying portion 4 at down flow side of the ink applying portion 3.

Figure 1:
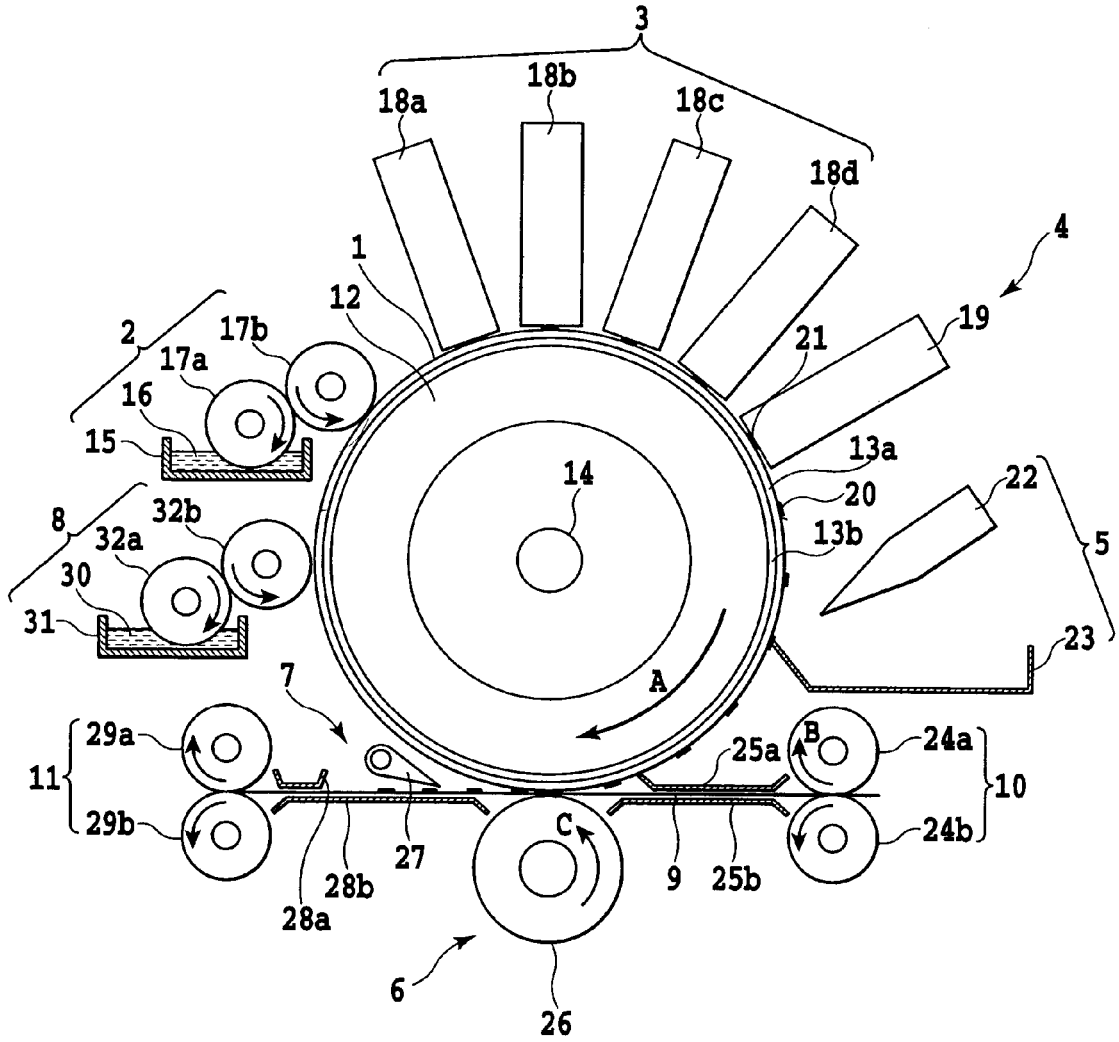
FIG. 1 is a schematic sectional view showing a conformation of the image forming portion of an ink-jet recording apparatus in accordance with an embodiment of the present invention.

FIG. 1 is a schematic sectional view showing a construction of the image forming portion of an ink-jet recording apparatus in accordance with an embodiment of the present invention.

In FIG. 1, the transfer drum 1 is an intermediate transfer body having a releasing surface layer. The transfer drum 1 is supported by an unshown shaft and can be rotatingly driven in the direction of the arrow A with an unshown drum driving device. Towards circumference of the transfer drum 1, an image fixing component coating portion 2, an ink applying portion 3, a supplementary liquid applying portion 4, an ink image treatment portion 5, a transfer portion 6, a recording media separation portion 7, and a cleaning portion 8 are arranged in this order from up flow side to down flow side. Further, a paper feed/transportation portion 10 for delivering a recording medium 9 from an unshown recording media storage portion (paper feed cassette) to a nip portion to be described below, and a paper discharge/transportation/fixing portion 11 for discharging recording media to a paper discharge tray 9, and having a fixing mechanism for fixing ink images on the recording media 9 after the ink images are transferred from the transfer body, i.e. transfer drum 1, to the recording media 9 are arranged. Also, the ink-jet recording apparatus has an unshown control portion.

The constructions of each above-mentioned portion are further precisely described.

Figure 4:
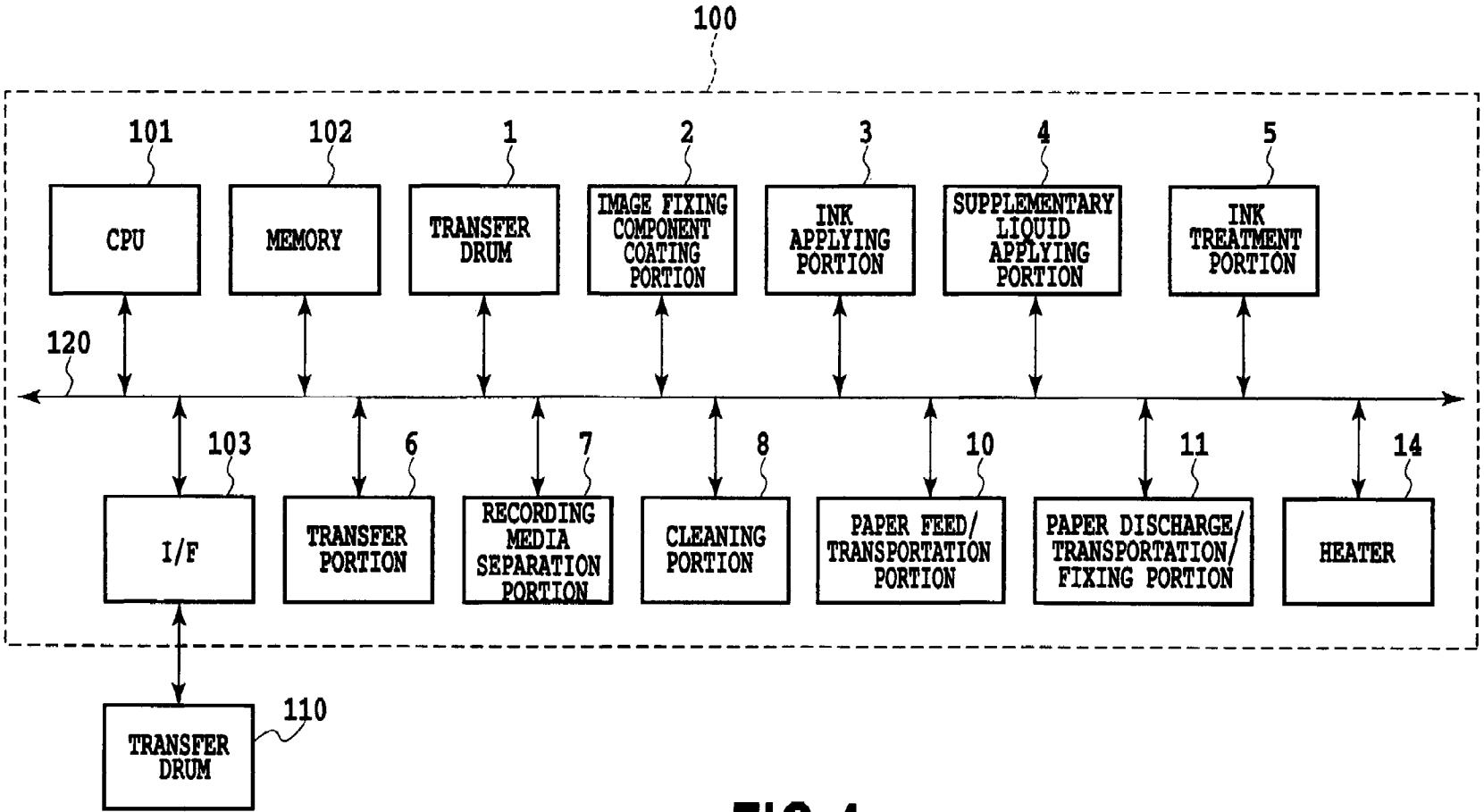
FIG. 4 is a schematic block diagram showing conformation of a controlling portion in accordance with an embodiment of the present invention.

FIG. 4 is a schematic block diagram showing configuration of a controlling portion in accordance with an embodiment of the present invention. In an ink-jet recording apparatus wholly indicated by reference numeral 100 in FIG. 4, CPU 101 implements control and data processing of operation of the present ink-jet recording apparatus. A memory 102 has a ROM (unshown) storing programs for those procedures, etc., and a RAM (unshown) used as a work area, etc., for implementation of those procedures. An I/F 103 is an interface for transfer of information such as data and commands between an ink-jet recording apparatus and an image supply apparatus 110 that is a source of supply of image data such as host computers.

Besides the above-mentioned portions, a transfer drum 1, an image fixing component coating portion 2, an ink applying portion 3, a supplementary liquid applying portion 4, an ink image treatment portion 5, a transfer portion 6, a recording media separation portion 7, a cleaning portion 8, a paper feed/transportation portion 10, a paper discharge/transportation/fixing portion 11, and a heater 14 are connected to a bus line 120. Therefore, a CPU 101 can exchange information with each portion through the pass line 120. Further, each portion, i.e. subject of control, is provided with a sensor for detecting state. Each of detection signals detected each portion can be transferred to the CPU 101 through the bus line 120.

As shown in FIG. 1, a transfer drum 1, that is an intermediate transfer body having a releasing surface layer, has two silicone rubber layers laminated as surface layers 13*a* and 13*b* around an aluminum support 12. The material used as the support 12 is not particularly limited to aluminum, but metals such as nickel and phosphate iron, thermosetting resins with excellent strength such as acetal, or materials molded with ceramics can also be used. Although the releasing layer in FIG. 1 has two silicone rubber layers, the layer structure does not need to be limited to this, but may be changed in accordance with its elastic property.

In the present embodiment, the surface of the transfer drum 1 has releasing property so that the surface of the transfer drum 1 can be easily cleaned leaving no ink after the transfer process.

The outermost surface layer 13*a* of the transfer drum 1 having a releasing surface layer has a property of easily releasing ink images (releasing property) on the surface. Silicone rubber is one of the most appropriate materials for forming the surface layer 13*a*, since it has low surface energy and highly releasing property. As other examples of materials for forming the surface layer 13*a*, for example, fluoro-silicone rubber, phenylsilicone rubber, fluorocarbon rubber, chloroprene rubber, nitrile rubber, ethylene-propylene rubber, natural rubber, styrene rubber, isoprene rubber, butadiene rubber, ethylene-propylene-butadiene copolymer, and nitrile-butadiene rubber can be named. As especially preferable materials, silicone rubber, fluoro-silicone rubber, phenylsilicone rubber, fluorocarbon rubber, and chloroprene rubber can be named. The surface layer 13*b*, which is an under-layer of the surface layer 13*a* for optimizing the elastic property of the rubber layer constructing the surface of the support 12, can be formed by appropriately using the materials named above.

Although the surface of the surface layer 13*a* is described above as having releasing property, it is not limited to have releasing property. From the view point of improvement of transfer ratio, however, it is preferably a releasing material, and also a non-permeable (non-absorbable) material. Here, releasing property indicates characteristic of easy releasing reacting liquids (image fixing components), inks applied on the surface, and ink images formed by inks and reacting liquids (image fixing components), or the like. Higher releasing property provides more advantage in terms of transfer ratio of the ink images and load for driving cleaning components in cleaning or the intermediate transfer body. On the other hand, it reduces critical surface tension of the material rendering it repelling so that liquids such as inks become difficultly adherable to the surface and reacting liquids (image fixing components) and ink images become difficult to be held. In the present invention, a releasing surface indicates a surface with critical surface tension of 30 mN/m or below, or contact angle to water of 75° or above.

Inside the transfer drum 1 is embedded a heater 14 for ensuring temperature stability of the transfer drum 1. For the heater 14, ordinarily used means of heating such as a halogen lamp can be appropriately used. The preset temperature is preferably 20-100° C., and more preferably 25-80° C., as the surface temperature of the transfer drum 1.

The image fixing component coating portion 2 in FIG. 1 comprises a coating liquid container 15, an image fixing component 16, and coating rollers 17*a* and 17*b*.

The image fixing component coating portion 2 coats the transfer drum 1 with the image fixing component 16 in the coating liquid container 15.

The image fixing component coating portion 2 is positioned at the up-flow side of an ink applying portion 3 to be described below on the transfer drum 1. The coating roller 17*b* is either rotated driven by the transfer drum 1 (driven rotation), or controllably rotated with an independent coating roller driving means (unshown). The coating roller 17*a* is either rotated driven by the coating roller 17*b*, or controllably rotated with an independent coating roller driving means. Thus, the image fixing component 16 is coated on the surface of the transfer drum 1 by rotation of the two coating rollers 17*a* and 17*b*. The thickness of coating of the image fixing component 16 is preferably set in the range of 0.1-10 μm depending on the concentration of the image fixing component 16. Too low thickness of the coated image fixing component may cause uneven reaction of the image fixing component with inks due to irregularity of coating. Too high thickness, on the other hand, may cause beading due to movement of coagulated inks on the image fixing component surface. Although the coating rollers 17*a* and 17*b* are preferably made of materials with good wettability with the image fixing component 16, porous or concavo-convex materials such as materials like gravure rolls can also be used.

Further, the means of applying of the image fixing component 16 is not limited to rollers, but means capable of applying the image fixing component 16 onto the transfer drum 1 such as a method of controlling the amount of applying with a blade, and a method of applying using a spray or a ink-jet print head can be used appropriately. In particular, in the case of the ink-jet system, it is possible to accurately apply the image fixing components to patterns formed according to recording images. Further, the image fixing component coating portion 2 is configured so as to enable control disjunction from the transfer drum 1 with a junction control apparatus (unshown).

Here, the image fixing component 16 related to the present invention will be described in detail. An image fixing component is a material for reducing flowability of coloring inks. In detail, it is a liquid whose task is to reduce flowability of inks on the intermediate transfer body by contacting with the inks to hold the inks landed on the intermediate transfer body at the positions of landing as far as possible. Here, image fixing includes not only the case where colorants and resins that are parts of compositions constructing ink react chemically or are absorbed physically resulting in reduction of flowability of the whole ink, but also the case where coagulation of solid components constructing ink reduces flowability locally. Without reduction of flowability of ink landed on the intermediate transfer body with releasing property, the ink flows on the intermediate transfer body causing beading and bleeding. Therefore, an image fixing component is used to react with the ink for reducing the flowability of the ink brought in touch with it and make the ink landed on the intermediate transfer body with releasing property to be held at the position of landing. Thus, beading and bleeding can be restrained to occur even when ink drops are brought in touch with one another on the intermediate transfer body.

As an image fixing component, materials that coagulate ink when brought in touch with the ink, such as liquids containing metal salts, are suitable. As the most suitable metal salts comprising an image fixing component 16, multivalent metal salts can be named. Multivalent metal salts consist of multivalent metal ions with two or more valences and anions bonded to the multivalent metal ions. As concrete examples of multivalent metal ions, bivalent metal ions such as $Ca^{2+}$, $Cu^{2+}$, $Ni^{2+}$, $Mg^{2+}$, and $Zn^{2+}$, and trivalent metal ions such as $Fe^{3+}$ and $Al^{3+}$ can be named. As anions bonded to them, anions such as $Cl^-$, $NO_3^-$, $SO_4^{2-}$, $I^-$, $Br^-$, $ClO_3^-$, $RCOO^-$ (R is an alkyl group) can be named.

The image fixing component 16 may contain water-soluble organic solvents named below together with metal salts such as the multivalent metal salts described above. As the water-soluble organic solvents, for example, amides such as dimethylformamide and dimethylacetamide, ketones such as acetone, ethers such as tetrahydrofuran and dioxane, polyalkylene glycols such as polyethylene glycol and polypropylene glycol, alkylene glycols such as ethylene glycol, propylene glycol, butylenes glycol, triethylene glycol, 1,2,6-hexanetriol, thidiglycol, hexylene glycol and diethylene glycol, lower alkyl ethers of multivalent alcohols such as ethylene glycol methyl ether, diethylene glycol monomethyl ether and triethylene glycol monomethyl ether, monovalent alcohols such as ethanol, isopropyl alcohol, n-butyl alcohol and isobutyl alcohol, glycerin, N-methyl-2-pyrilidone, 1,3-dimethyl-2-imidazolidinone, triethanolamine, sulfolane and dimethyl sulfoxide can be named. The content of water-soluble organic solvents such as those named above in the image fixing component 16 is in the range of 5 to 60% by weight, and preferably in the range of 5 to 40% by weight, of the total weight of the image fixing component, although there is no particular limit.

Further, the image fixing component 16 may contain a coagulation supplement such as water-soluble resins, water-soluble cross-linking agents and acid solutions. Preferably usable materials may be those that can coexist with multivalent metal salts. As a water-soluble resin, polyvinyl alcohol and polyvinyl pyrrolidone and the like can be used. Since these coagulation supplements have relatively high molecular weight, they can strengthen internal cohesive force of ink coagulation images formed by their simultaneous use with multivalent metal salts. As a result, transfer ratio of the ink coagulation images and their abrasion resistance can be strengthened.

Further, the image fixing component 16 may contain a coating aid for the purpose of ensuring even coating of the image fixing component 16 on the transfer drum 1. A surfactant may be preferably used as the coating aid. As the surfactant, for example, Surflon S-141 (trade name, from Seimi Chemical Co.), Silwet L-77 (trade name, from Nippon Unicar Co.) and the like can be used. The surfactant used in the present invention is not limited to them, but various other surfactants such as fluorine-based surfactants, silicone-based surfactants, water-soluble cationic surfactants, nonionic surfactants, and ampholytic surfactants can be used.

Preferable concrete examples of cationic surfactants are aliphatic amine salts, quaternary ammonium salts, sulfonium salts, phosphonium salts, and the like.

Preferable concrete examples of nonionic surfactants are fluorine-based ones, silicone-based ones, acrylic acid copolymers, polyoxyethylene alkyl ethers, polyoxyethylene alkylphenyl ethers, polyoxyethylene secondary alkyl ethers, polyoxyethylene sterol ethers, polyoxyethylene lanolin derivatives, ethylene oxide derivatives of alkylphenol formalin condensates, polyoxyethylene-polyoxypropylene block copolymers, fatty acid ester types of polyoxyethylene-polyoxypropylene alkyl ether polyoxyethylene compounds, polyethylene oxide condensate type polyethylene glycol fatty acid esters, fatty acid monoglycerides, polyglycerine fatty acid esters, sorbitan fatty acid esters, propyleneglycol fatty acid esters, sucrose fatty acid esters, fatty acid alkanolamides, polyoxyethylene fatty acid amides, polyoxyethylene alkylamine oxides, and the like.

Preferable concrete examples of ampholytic surfactants are carboxybetaine types, aminocarboxylic acid salts, lecithin, and the like.

The amount of addition of these surfactants is preferably about 0.05-10% by weight, more preferably 0.1-5% by weight, of the image fixing component 16.

Additives such as viscosity modifiers, pH adjusters, antiseptics, and antioxidants may be added to the image fixing component 16, if necessary. Although the image fixing component 16 of the present invention is preferably colorless, they may be light-colored so long as it does not change the color tone of colored inks when mixed with them on recording media. Further, physical properties of the image fixing component 16 including above-mentioned formation materials are preferably adjusted so that its viscosity at about 25° C. is in the range of 1-30 cps. (mPa·s).

The image fixing component 16 in this embodiment is configured including metal salts, while it may be configured without metal salts as long as it reduces flowability of inks.

In FIG. 1, the ink applying portion 3 forms ink images by applying inks at least containing colorants from the print head to an intermediate transfer body coated with an image fixing component such as mentioned above, in accordance with image signals sent from the control portion.

In FIG. 1, the ink applying portion 3 is positioned at down flow side of the image fixing component coating portion 2 on the transfer body, and comprising print heads 18*a*, 18*b*, 18*c*, and 18*d*. In the present embodiment, the print heads 18*a*, 18*b*, 18*c*, and 18*d* are comprehensively called a print head 18. In an ink-jet recording apparatus related to the present embodiment, a line type ink-jet print head of the type that uses a heater element (a thermoelectric conversion element) is used as the print head 18. The print heads 18*a*, 18*b*, 18*c*, and 18*d* are arranged at constant intervals in the direction of the circumference of the transfer drum 1. Although line type ink-jet print heads are used in the construction of FIG. 1, a print head with a row of plurality of nozzles for inks of different colors aligned in a predetermined range in the direction of circumference or the direction of the shaft (direction perpendicular to the paper in FIG. 1) of the transfer drum 1 (to be called a "serial type print head" below, in this specification) may be used to form images sequentially on the transfer drum 1 by scanning this print head in the direction of the shaft. In the case of a serial head, rotary driving of the transfer drum 1 is stepwise driving against the row of nozzles of the head. Further, the ink-jet print head is not limited to the type that uses an above-mentioned heater element, but any type that can eject inks from nozzles such as one driven by a piezoelectric element can be used.

The four print head 18 described above is so conformed that each applies ink of different color. In the conformation of FIG. 1, the print head 18*a* applies yellow (Y), 18*b* applies magenta (M), 18*c* applies cyan C, and 18*d* applies black (K). The print head 18 consisting of them is supplied with inks of different colors from (unshown) ink tanks. The heating element of each print head generates heat in accordance with image signals corresponding to each color received from the control portion, and raises the temperature of ink supplied from each ink tank to generate bubbles. Expansion of the generated bubbles eject ink drops from plurality of nozzles of each print head 18. The number of ink-jet print heads conforming the ink applying portion, the order of ink colors ejected to the transfer drum 1, and the hue of inks used in the present invention are not limited by the description above.

The ink images formed on the transfer drum 1 should be mirror images of the images to be formed finally on recording the medium 9, considering that they are reversed on transfer. The image signals supplied to the print head 18 should naturally be image signals corresponding to the mirror images. Therefore, the control portion implements a mirror revere treatment (treatment for obtaining reverse data) to image signals sent from an image supply apparatus 110 (i.e. image signals corresponding to the images to be formed finally on the recording medium 9). Thus, the image signals corresponding to the mirror images are obtained and supplied to the print head.

The inks used in the ink applying portion 3 are not particularly limited, but any of generally used ink-jet inks can be used. Especially, pigment inks can be suitably used in the present embodiment, since they are not easily permeable to recording media and excellent in water resistance and light resistance in comparison with dye inks. Water-based pigment inks suitably usable in the present embodiment will be described below.

Pigments in pigment inks are used in the range of 1-20% by weight, preferably 2-12% by weight, of the total weight of the pigment inks. As the pigments used in the present embodiment are those named concretely below.

As a black pigment, carbon black can be named. For example, carbon black produced by the furnace method or the channel method having characteristics such as primary particle diameter of 15-40 mμ (nm), specific surface area by BET method of 50-300 $m^2/g$, DBP absorption value of 40-150 ml/100 g, volatile portion of 0.5-10%, and pH value of 2-9. Commercial products with such characteristics are, for example, No. 2300, No. 900, MCF88, No. 33, No. 40, No.45, No. 52, MA7, MA8, No. 2200B (from Mitsubishi Chemical), RAVEN1255 (from Columbia), REGAL400R, REGAL330R, REGAL660R, MOGUL L (from Cabot), Color Black FW1, COLOR Black FW1, COLOR Black FW18, Color Black S170, Color Black S150, Printex 35, Printex U (from Degussa), etc., can be used preferably.

As a yellow pigment, for example, C. I. Pigment Yellow 1, C. I. Pigment Yellow 2, C. I. Pigment Yellow 3, C. I. Pigment Yellow 13, C. I. Pigment Yellow 16, C. I. Pigment Yellow 83 can be named. As a magenta pigment, for example, C. I. Pigment Red 5, C. I. Pigment Red 7, C. I. Pigment Red 12, C. I. Pigment Red 48 (Ca), C. I. Pigment Red 48 (Mn), C. I. Pigment Red 57 (Ca), C. I. Pigment Red 112, C. I. Pigment Red 122 can be named. As a cyan pigment, for example, C. I. Pigment Blue 1, C. I. Pigment Blue 2, C. I. Pigment Blue 3, C. I. Pigment Blue 15:3, C. I. Pigment Blue 16, C. I. Pigment Blue 22, C. I. Pigment Blue 4, C. I. Pigment Blue 6 can be named. Needless to say, the present embodiment is not limited by them. Besides those named above, any of self-dispersed pigments, resin-dispersed pigments, and microencapsulated pigments can be used.

As a dispersing agent for dispersing above-mentioned pigments in water-based media used for production of water-based pigment inks, any water-soluble resins can be used. Among them, those with weight average molecular weight in the range of 1,000-30,000 can be preferably used, and those with weight average in the range of 3,000-15,000 can be more preferably used. As concrete examples of such dispersing agents, block copolymers, random copolymers, graft copolymers or their salts comprising two or more monomers (of which at least one is a hydrophilic polymerizable monomer) selected from styrene, styrene derivatives, vinyl naphthalene, vinyl naphthalene derivatives, aliphatic alcohol esters of α,β-ethylenic unsaturated carboxylic acids, acrylic acid, acrylic acid derivatives, maleic acid, maleic acid derivatives, itaconic acid, itaconic acid derivatives, fumaric acid, fumaric acid derivatives, vinyl acetate, vinylpyrrolidone, acrylamide, and their derivatives can be named. Natural resins such as rosin, shellac, and starch can also be used preferably. These resins are soluble in aqueous solutions in which a base is dissolved, i.e. they are alkali-soluble resins. The water-soluble resins used as pigment dispersing agents are preferably contained in the range of 0.1-5% by weight of total weight of pigment inks.

Especially, in the case of pigment inks containing above-mentioned pigments, the whole pigment inks are preferably adjusted neutral or alkaline. Thus, solubility of the water-soluble resins used as pigment dispersing agents is improved, resulting in pigment inks more excellent in long-life nature. In this case, however, it is preferable to adjust pH in a range of 7-10, since the solutions may cause corrosion of various parts used in ink-jet recording apparatuses. As the pH adjusting agents used here, for example, various organic amines such as diethanolamine and triethanolamine, inorganic alkalis such as alkali metal hydroxides, e.g. sodium hydroxide, lithium hydroxide, and potassium hydroxide, organic acids and mineral acids. Pigment inks are conformed by dispersing or dissolving in water-based media colorants such as pigments and water-soluble resins as dispersing agents described above.

Water-based solvents suitable for pigment inks are mixed solvents of water and water-soluble organic solvents, and it is preferable to use ion-exchanged water (deionized water) as the water instead of ordinary water containing various ions.

As examples of the water-soluble organic solvent used as a mixture with water, alkyl alcohols with 1-4 carbon atoms such as methyl alcohol, ethyl alcohol, n-propyl alcohol, isopropyl alcohol, n-butyl alcohol, sec-butyl alcohol, tert-butyl alcohol, amides such as dimethylformamide and dimethylacetamide, ketones or ketoalcohols such as acetone and diacetone alcohol, ethers such as tetrahydrofuran and dioxane, polyalkylene glycols such as polyethylene glycol and polypropylene glycol, alkylene glycols having alkylene groups with 2-6 carbon atoms such as ethylene glycol, propylene glycol, butylene glycol, triethylene glycol, 1,2,6-hexane triol, thioglycol, hexylene glycol and diethylene glycol, glycerine, lower alkyl ethers of multivalent alcohols such as ethylene glycolmonomethyl (or ethyl) ether, diethylene glycol methyl (or ethyl) ether and triethylene glycol methyl (or ethyl) ether, N-methyl-2-pyrrolidone, 2-pyrrolidone, and 1,3-dimethyl-2-imidazolidinone can be named. Among these many water-soluble organic solvents, multivalent alcohols such as diethylene glycol and lower alkyl ethers of multivalent alcohols such as triethylene glycol methyl (or ethyl) ether are preferable.

Content of the above-mentioned water-soluble organic solvents in pigment inks is generally in a range of 3-50% by weight of total weight of the pigment inks, and more preferably in a range of 3-40% by weight. Content of water used is in a range of 10-90% by weight of total weight of the pigment inks, and preferably in a range of 30-80% by weight.

Besides the above-mentioned ingredients, if necessary, surfactants, antifoaming agents, and preservatives may be added arbitrarily to obtain pigment inks with desired physical properties. Especially, surfactants that function as permeation promoters need to be added in appropriate amounts to play the role of helping the liquid ingredients of the image fixing components and pigment inks permeate recording media rapidly. The amount of addition is 0.05-10% by weight, and preferably 0.5-5% by weight. As an anionic surfactant, any of those generally used such as carboxylic acid salts, sulfate esters, sulfonic acid salts, and phosphoric acid salts can be suitably used.

In order to prepare a pigment ink comprising above-mentioned materials, the pigment is first added to an aqueous medium at least containing a water-soluble resin as a dispersing agent and water. Then, after mixing and agitation, dispersion is implemented using a dispersing means to be described below, and centrifugal separation is carried out if necessary to obtain a desired dispersion. Then, after addition of a sizing agent and additives appropriately selected as described above, a pigment ink is obtained by agitation.

In case an alkali-soluble resin described above is used as the dispersing agent, addition of base is required to dissolve the resin. As the base used here, organic bases such as monoethanolamine, diethanolamine, triethanolamine, aminomethylpropanol and ammonia and inorganic bases such as potassium hydroxide and sodium hydroxide are preferably used.

In preparation of a pigment ink, it is effective to implement premixing for 30 minutes by agitation of aqueous medium containing the pigment before dispersing treatment Such a premixing treatment is preferable because the treatment can improve wettability of the pigment surface and promote adsorption of the dispersing agent on the pigment surface.

The dispersing machine used in dispersing treatment of the above-mentioned pigments can be any of the generally used dispersers such as ball mills, roll mills, and sand mills. Among them high speed type sand mills are preferably used. As such, for example, super mills, sand grinders, beads mills, agitator mills, grain mills, dinoh mills, par mills, Cobol mills (all are trade names) can be named.

In an ink-jet recording method using pigment inks, pigments with optimum particle size distribution are used because of request of clogging resistance, etc. As a method for obtaining pigments with desirable particle size distribution, minimization of the size of grinding media of the disperser, maximization of filling rate of grinding media, lengthening of the time of treatment, delaying of rate of eject, classification with a filter or a centrifuge after grinding, and combination of them can be named.

In the ink applying portion 3, pigment inks such as described above are used to apply ink drops to an intermediate transfer body (transfer drum 1) coated with the above-mentioned image fixing component 16 by means of a print head having plurality of nozzles capable of controllably ejecting in accordance with image signals sent from the control portion, to form ink images on the transfer drum 1 (an ink image forming step). In the present embodiment, the inks rapidly coagulate through reaction of the image fixing component 16 coated on the transfer drum 1 and the pigment inks applied from the print head 18, resulting in formation of ink coagulation images on the transfer drum 1. Especially in the present embodiment, for example, metal salts, i.e.

metal ions that function as image fixing components rapidly react with pigment inks and coagulate them. Thus, good ink coagulation images without beading or bleeding can be formed on the transfer drum 1. Although pigment inks using pigments as colorants have been described above as an example, the present embodiment is not limited with them but mixed inks containing dyes added to pigments, for example, can also be used. Further, water-soluble resins and cross-linking agents can also be added to the inks and/or image fixing components to strengthen internal coagulation force of the ink coagulation images, as long as the image fixing components contain metal salts. The ink applying portion 3 of FIG. 1 is there to realize the ink image formation process described above.

Next, in FIG. 1, the supplementary liquid applying portion 4 comprises a print head 19 for applying supplementary liquid. In the supplementary liquid applying portion 4, supplementary liquid 21 is applied from the print head 19 for applying supplementary liquid in accordance with the ink images 20 formed in the ink applying portion 3.

In FIG. 1, a supplementary liquid applying portion 4 is arranged at down flow side of the ink applying portion 3 on the transfer drum 1. In the present embodiment, a line-type ink-jet print head of the type that uses heating elements is used as the print head 19 for applying supplementary liquid. The print head 19 for applying supplementary liquid is positioned at down flow side of the circumference direction of the transfer drum 1 parallel with the print heads 18*a*, 18*b*, 18*c* and 18*d* of the print head of the ink applying portion 3. Although a line-type ink-jet print head is used as the print head for applying supplementary liquid in FIG. 1, a conventional serial-type print head can naturally be used to apply the supplementary liquid sequentially to the ink images 20 formed on the transfer drum 1 by scanning the print head in the direction of the shaft. Further, the ink-jet print head is not limited by the type described above, but any type such as ones driven by a piezoelectric element can be used as long as they can eject inks.

Further, although a print head is used as the means for applying supplementary liquid in the present embodiment, any means capable of applying supplementary liquid to the transfer drum, such as a spray or a roller for applying supplementary liquid, can be applied.

The image signals supplied to the print head 19 for applying supplementary liquid are logical sum signals obtained by logically summing four binary format image signals supplied to the print heads 18*a*, 18*b*, 18*c* and 18*d* of the ink applying portion 3. Thus, the supplementary liquid 21 is not applied where the inks are not deposited on the transfer drum 1, but the supplementary liquid 21 is applied only where the inks are deposited.

The supplementary liquid related to the present embodiment will be described below.

The supplementary liquid is a material for improving abrasion resistance (fixability) of final images on recording media 9, i.e. target of transfer. As one of the methods for improving abrasion resistance of images on recording media, it is effective to have the images contain much resin that contributes to adhesiveness to recording media. Applying the supplementary liquid containing resin to ink images 20 formed on the intermediate transfer body, i.e. the transfer drum 1, increases the ratio of resin as a component of ink images 20. Since the ink images are transferred in such a condition, the images after transfer naturally contain much resin. Thus, abrasion resistance of the images after transfer increases. Further in applying supplementary liquid 21 to ink images 20 on the transfer drum 1, application of the supplementary liquid 21 before formation of ink images 20 adds to their releasing property from the transfer drum 1. Also, application of the supplementary liquid 21 after formation of ink images adds to their adhesiveness to recording media 9, and as a result is advantageous in transferring property. In the present embodiment, the supplementary liquid 21 comprises, as main ingredients, ingredients other than pigments and dyes that are colorants used in ordinary inks.

In the composition of the supplementary liquid 21, water-soluble resins and water-soluble cross-linking agents can be used as the resin for improving abrasion resistance. Although any water-soluble resins can be used, it is appropriate to change kinds of the water-soluble resins in accordance with application means. In case means for applying supplementary liquid 21 is a print head, for example, those with weight average molecular weight preferably in the range of 1,000-30,000, more preferably in the range of 3,000-15,000, are used. In the case of means such as roller coating, those with even higher weight average molecular weight can be used. As concrete examples of such water-soluble resins, block copolymers, random copolymers, graft copolymers or their salts comprising two or more monomers (of which at least one is a hydrophilic polymerizable monomer) selected from styrene, styrene derivatives, vinyl naphthalene, vinyl naphthalene derivatives, aliphatic alcohol esters of a,β-ethylenic unsaturated carboxylic acids, acrylic acid, acrylic acid derivatives, maleic acid, maleic acid derivatives, itaconic acid, itaconic acid derivatives, fumaric acid, fumaric acid derivatives, vinyl acetate, vinyl alcohol, vinylpyrrolidone, acrylamide, and their derivatives can be named. Alternatively, natural resins such as rosin, shellac, and starch can be used preferably. These resins are alkali-soluble resins that are soluble in aqueous solutions in which bases are dissolved. These water-soluble resins are preferably contained in the range of 0.1-20%, more preferably 0.1-10%, by weight of the total weight of the supplementary liquid 21.

Use of water-soluble resins as the supplementary liquid 21 as described above results in existence of many resin layers on the images after transfer as described below. Thus, abrasion resistance (fixability) of final images on the recording media 9 is improved.

As the pH adjusters used for dissolution of resins, for example, various organic amines such as diethanolamine and triethanolamine, inorganic alkalis such as sodium hydroxide, lithium hydroxide and potassium hydroxide, organic acids and mineral acids are named. The water-soluble resins such as described above are dispersed or dissolved in aqueous solvents to form the supplementary liquid 21.

Water-based solvents suitable to form the supplementary liquid 21 are mixed solvents of water and water-soluble organic solvents, and it is preferable to use ion-exchanged water (deionized water) as the water instead of ordinary water containing various ions.

As examples of the water-soluble organic solvent used as a mixture with water, alkyl alcohols with 1-4 carbon atoms such as methyl alcohol, ethyl alcohol, n-propyl alcohol, isopropyl alcohol, n-butyl alcohol, sec-butyl alcohol, tert-butyl alcohol, amides such as dimethylformamide and dimethylacetamide, ketones or ketoalcohols such as acetone and diacetone alcohol, ethers such as tetrahydrofuran and dioxane, polyalkylene glycols such as polyethylene glycol and polypropylene glycol, alkylene glycols having alkylene groups with 2-6 carbon atoms such as ethylene glycol, propylene glycol, butylene glycol, triethylene glycol, 1,2,6-hexane triol, thioglycol, hexylene glycol and diethylene glycol, glycerine, lower alkyl ethers of multivalent alcohols such as ethylene glycol monomethyl (or ethyl) ether, diethylene glycol methyl (or ethyl) ether and triethylene glycol methyl (or ethyl) ether, N-methyl-2-pyrrolidone, 2-pyrrolidone, and 1,3-dimethyl-2-imidazolidinone can be named. Among these many water-soluble organic solvents, multivalent alcohols such as diethylene glycol and lower alkyl ethers of multivalent alcohols such as triethylene glycol monomethyl (or ethyl) ether are preferable.

Content of the above-mentioned water-soluble organic solvents in the supplementary liquid 21 is generally in a range of 3-50% by weight of total weight of the supplementary liquid 21, and more preferably in a range of 3-40% by weight. Content of water used is in a range of 10-90% by weight of total weight of the supplementary liquid 21, and preferably in a range of 30-80% by weight.

Besides the above-mentioned ingredients, if necessary, surfactants, antifoaming agents, and preservatives may be added arbitrarily to obtain supplementary liquid 21 with desired physical properties. Especially, surfactants that function as surface tension adjusters for ensuring stable ejection of the supplementary liquid 21 from the print head 19 for applying supplementary liquid need to be added in appropriate amounts. The amount of addition, for example, is 0.05-10% by weight, and preferably 0.5-5% by weight.

As anionic surfactant that can be added to the supplementary liquid 21, any of those generally used such as carboxylic acid salts, sulfate esters, sulfonic acid salts, and phosphoric acid salts can be preferably used. Further, the supplementary liquid 21 may include the above-mentioned image fixing component.

Next, in FIG. 1, the ink image treatment portion 5 comprises an air knife 22 and a solvent saucer 23.

The ink image treatment portion 5 carries out treatment of ink image 20 to ensure more optimum condition in transfer of the ink image 20 formed in the ink applying portion 3 to the recording media 9.

In FIG. 1, an ink image treatment portion 5 is arranged at down flow side of a supplementary liquid coating portion 4. The ink image treatment portion is provided with an air knife 22 that sends warm air heated by an unshown heater to remove the liquid media in the ink, mainly water in the ink, by evaporation or separation, and a solvent saucer 23. Namely, the ink image treatment portion 5 is provided for the purpose of controlling transfer characteristics of ink image 20 to recording media 9 with the amount of air sent from the air knife and the amount of heat related to the temperature of air, taking in account the permeability of the ink image 20, ink coagulation image, to the recording media 9.

Although an air knife 22 is used as a means of drying of the ink image 20 in the present embodiment, any means such as an infrared heater that can control temperature and that can control characteristics of ink images can be used.

In FIG. 1, the transfer portion 6 comprises a transfer roller 26. The paper feed/transportation portion 10 comprises transportation rollers 24*a* and 24*b*, and transportation guides 25*a* and 25*b*.

In the transfer portion 6, ink images 20 on the transfer drum 1 is press-transferred with the transfer roller 26 on the recording media 9 transported with transportation rollers 24*a* and 24*b* and transportation guides 25*a* and 25*b* of the paper feed/transportation portion 10.

The transfer roller 26 is positioned to pass the recording media 9 through the nip portion between the transfer drum 1 and the transfer roller 26, and can be formed with a rubber roller or a metal roller. In the transfer portion 6, control of release of pressure on the transfer drum 1 is possible with an unshown pressure control apparatus. In the figure, the transportation rollers 24*a* and 24*b* rotate in the direction of an arrow B, and the transfer roller 26 rotates in the direction of C. The transfer roller 26 is either rotated driven by the transfer drum 1 (driven rotation) through the recording media 9, or controllably rotated with an independent transfer roller driving means (unshown). In FIG. 1, rotation of the transfer roller is driven rotation. Although the transfer roller 26 is conformed to pressurize the transfer drum 1 with a linear load of 0.6 kg/cm$^2$ through the recording media 9 during transfer in the present embodiment, it is not limited to this.

In FIG. 1, the recording medium separation portion 7 comprises a paper lifter 27.

In the recording media separation portion 27, the paper lifter 27 works in accordance with transportation timing of the recoding media 9.

After the above-mentioned transfer finishes, the paper lifter 27 is driven by an unshown driving device to separate the recording media 9 from the transfer drum 1, and guides the recording media 9 to the paper discharge/transportation/fixing portion 11 by means of transportation guides 28*a* and 28*b*.

In FIG. 1, the paper discharge/transportation/fixing portion 11 comprises transportation guides 18*a* and 28*b* and transportation/fixing rollers 29*a* and 29*b*.

In the paper discharge/transportation/fixing portion 11, the recording media 9 on which ink images are transferred and which is guided with transportation guides 28*a* and 28*b* are heated with transportation/fixing rollers 29*a* and 29*b* equipped with infrared heaters to fix the ink images, and sent to an unshown paper discharge tray with rotation of the rollers. Recording finishes by the above operations.

As the transportation/fixing rollers 29*a* and 29*b*, conventionally known fixing rollers can be used, preferably at a temperature of 30-200° C. The rollers are formed with such materials as metal rollers and silicone rubber. Silicone oil, etc. may be coated on the surface of the rollers to improve releasing property.

In FIG. 1, a cleaning portion 8 comprises a cleaning liquid 30, a cleaning liquid holding part 31 holding the cleaning liquid 30, a cleaning liquid supply roller 32*a* for coating the transfer drum 1 with the cleaning liquid 30 to remove dust, and a cleaning roller 32*b*.

In the same figure, the cleaning roller 32*b* is either driven by the transfer drum 1 (driven rotation) or capable of being controllably driven with an unshown driving means. The cleaning liquid supply roller 32*a* is either driven by the cleaning roller 32*b* or capable of being controllably driven with an unshown driving means. As described above, the cleaning liquid 30 is coated on the transfer drum 1 by the rotation of the cleaning liquid supply roller 32*a* and the cleaning roller 32*b*. The cleaning portion 8 carries out cleaning of the transfer drum 1 as described above.

Although there is no limit in the device conformation or the cleaning liquid 30 of the cleaning portion 8, it is preferable to use the aqueous solution containing surfactant, water-soluble organic solvent and so on used for the above-mentioned image fixing component 16.

A series of operation of an ink-jet recording apparatus of the present embodiment with the above-mentioned conformation will be described in detail below with reference to FIG. 1.

When the power to the ink-jet recording apparatus is switched on, the transfer drum 1 starts driven rotation, and each heater inside the transfer drum 1, of the air knife 22, and of the transportation/fixing rollers 29*a* and 29*b* is turned on and starts heating each portion to each preset temperature. On receiving image signals from an image supply device 110 such as a computer, the coating roller 17*b* conforming the image fixing component coating portion 2 abuts the transfer drum 1. Then, rotation of the coating roller 17*a* allows the image fixing component 16 to coat the coating roller 17*b* through the coating roller 17*a*, and the transfer drum 1 is evenly coated with the image fixing component 16. After the image fixing component 16 is coated on the transfer drum 1 in one rotation of the transfer drum 1, the coating roller 17*b* is detached from the transfer drum 1. Naturally, while the image fixing component 16 is being coated on the transfer drum 1, ink images can be formed in the ink applying portion 3 on the region of the transfer drum 1 where the image fixing component 16 is coated.

Here, multivalued image signals (to be called "external image signal" below in the specification) corresponding to each ink color (C, M, Y, K) used in the present embodiment are sent from the image supply apparatus 110, and are converted to binary format image signals corresponding to the multivalued image signals, Y, M, C, K. Then, a mirror image inversion treatment is applied to the binary format image signals corresponding to each color to obtain binary reverse image signals corresponding to each color.

Next, the binary reverse image signals corresponding to each color are sent to each print head 18, wherein, concurrently with rotation of the transfer drum 1, inks of each color are sequentially ejected from the print heads 18*a*, 18*b*, 18*c* and 18*d* and applied to the transfer drum 1. In the occasion, the inks react with the image fixing component 16 coated on the transfer drum 1 to form ink images 20 with coagulated colors on the transfer drum 1. Obviously the ink images are mirror images of the images to be formed finally on the recording media 9.

Subsequently, logical sum signals of the binary reverse image signals corresponding to each color are sent to the print head 19 for applying the supplementary liquid 21, and the supplementary liquid 21 is ejected from the print head 19 for applying supplementary liquid concurrently with rotation of the transfer drum 1 and applied to the ink images 20, i.e. ink coagulation images, on the transfer drum 1. The ink images 20 applied the supplementary liquid are dried in the ink treatment portion 5 by evaporation of the solvent for optimization of the condition for transfer to be implemented later.

The recording media 9 are transported by means of the transportation rollers 24*a* and 24*b* to the transfer portion 6, so that front edge of ink images formed on the transfer drum 1 as described above and the recording media 9, i.e. transfer receiving media, lap in the nip portion, i.e. position of transfer. In the transfer portion 6, the transfer roller 26 is activated when an unshown sensor detects that the front edge of the recording media 9 reached the nip portion of the transfer drum 1 and the transfer roller 26. Then, the transfer roller 26 is pressed against the transfer drum 1 across the recording media 9, preset transfer pressure is generated by means of a pressure control apparatus, and the ink images 20 on the transfer drum 1 are transferred to the recording media 9.

Next, at the same time when an unshown sensor detects that the front edge of the recording medium 9 is discharged from the transfer portion 6, the paper lifter 27 is activated, inserted between the transfer drum 1 and the recording medium 9, and separates the recording medium 9 from the transfer drum 1. Then, heat and pressure are applied to the recording medium 9 separated from the transfer drum 1 for fixing treatment by means of the transportation guides 28*a* and 28*b*, and the transportation/fixing rollers 29*a* and 29*b*, and the recording medium 9 is discharged to a discharge tray. After all the inks on the transfer drum 1 are transferred to the recording medium 9, the transfer roller 26 and the paper lifter 27 are detached.

Next, the cleaning roller 32*b* is abutted to the transfer drum 1, and cleans the surface of the transfer drum 1 by coating the cleaning liquid 30. After one rotation of the transfer drum 1, the cleaning roller 32*b* is detached from the transfer drum 1. In case recording is continued, the above-mentioned operation is repeated corresponding to external image signals. In case power is turned off to finish recording operation, after each heater is turned off and rotation of the transfer drum 1 is stopped, power to the ink-jet recording apparatus is turned off to finish operation of the apparatus.

As described above, in the present embodiment, the image fixing component coating portion 2 is so conformed that an intermediate transfer body, i.e. transfer drum 1, is coated with an image fixing component 16 at least containing metal salts, and then inks are applied to at least part of the coated region to form ink images in an ink applying portion 3, wherein rapid reaction of metal ions in the image fixing component 16 with pigment inks causes coagulation forming ink images of the state. Thus, good ink images 20 without beading or bleeding are formed on the intermediate transfer body. Further, a supplementary liquid 21 containing resins for enhancing adhesiveness to the recording medium is applied to the ink images 20, and the ink images 20 are dried in the ink treatment portion 5 and transferred to a recording medium 9 in the transfer portion 6. Therefore, high quality images without beading or bleeding and with good abrasion resistance (fixability) to prevent wearing of inks on the recording media after transfer can be formed on the recording media. Transfer efficiency may also be improved, since releasing property and adhesiveness of ink images during transfer are enhanced with the image fixing component 16 and the supplementary liquid 21.

Examples of the present embodiment using example of the above-mentioned image fixing component, colored inks, and supplementary liquid are concretely described below.

EXAMPLE 1

In the description blow, parts (pts) and % are weight-based unless otherwise noticed. Total amounts of both inks and image fixing components are adjusted with water to 100 parts.

[Preparation of Pigment Inks]

First, black, cyan, magenta and yellow pigment inks each containing pigment and anionic compounds were prepared as described below.

(Preparation of Pigment Ink K1)

<Preparation of Pigment Dispersion>

| | |
|---|---|
| Styrene-acrylic acid-ethyl acrylate copolymer (acid value 240, weight average molecular weight = 5,000) | 1.5 parts |
| Monoethanolamine | 1.0 parts |
| Diethylene glycol | 5.0 parts |
| Ion-exchanged water | rest |

The above-mentioned ingredients were heated in a water bath at 70° C. to dissolve the resin completely. To the solution, 10 parts of newly experimentally produced carbon black (MCF88, from Mitsubishi Chemical) and 1 parts of isopropyl alcohol were added, premixed for 30 minutes, and dispersion-treated under the condition described below.

| | |
|---|---|
| Dispersion machine: | a sand grinder (from Igarashi Machinery) |
| Grinding media: | zirconium beads, 1 mm diameter |
| Filling ratio: | 50% (by volume) |
| Grinding time: | 3 hours |

Further, black pigment dispersion was prepared by centrifugation (12,000 rpm, 20 min.) to remove coarse particles.

<Preparation of Inks>

A black pigment ink K1 containing pigment was prepared using the above-mentioned dispersion by mixing the ingredients in the composition shown below. The surface tension of the ink was 34 mN/m.

| | |
|---|---|
| Above-mentioned pigment dispersion | 30.0 parts |
| Glycerin | 10.0 parts |
| Ethylene glycol | 5.0 parts |
| 2-pyrrolidone | 5.0 parts |
| Acethylenol EH (from Kawaken Fine Chemical) | 1.0 parts |
| Ion-exchanged water | rest |

(Preparation of Pigment Ink C1)

A cyan-colored pigment ink C1 was prepared in the same manner as in the preparation of pigment ink K1 except that 10 parts of carbon black (MCF88, from Mitsubishi Chemical) used for preparation of pigment ink K1 was replaced by pigment blue 15.

(Preparation of Pigment Ink M1)

A magenta-colored pigment ink M1 was prepared in the same manner as in the preparation of pigment ink K1 except that 10 parts of carbon black (MCF88, from Mitsubishi Chemical) used for preparation of pigment ink K1 was replaced by pigment red 7.

(Preparation of Pigment Ink Y1)

A yellow-colored pigment ink Y1 was prepared in the same manner as in the preparation of pigment ink K1 except that 10 parts of carbon black (MCF88, from Mitsubishi Chemical) used for preparation of pigment ink K1 was replaced by pigment yellow 74.

[Preparation of an Image Fixing Component]

Next, an image fixing component containing a multivalent metal salt and a surfactant was prepared as described below.

(Preparation of Image Fixing Component R1)

A composition of the ingredients shown below was mixed and dissolved, filtered through a membrane filter with pore size of 0.22 μm under pressure to obtain an image fixing component R1.

| | |
|---|---|
| Diethylene glycol | 10.0 parts |
| Calcium chloride dihydrate | 10.0 parts |
| Acethylenol EH (from Kawaken Fine Chemical) | 0.5 parts |
| Ion-exchanged water | rest |

[Preparation of a Supplementary Liquid]

Next, a supplementary liquid including a resin and a surfactant was prepared as described below.

(Preparation of a Supplementary Liquid S1)

Ingredients in the composition ratio shown below were mixed to prepare a supplementary liquid S1.

| | |
|---|---|
| Hexylene glycol | 10.0 parts |
| Ethylene glycol | 5.0 parts |
| 2-pyrrolidone | 5.0 parts |
| Polyvinylpyrrolidone (K-15; molecular weight 10000) | 5.0 parts |
| Acetylenol EH (from Kawaken Fine Chemicals) | 0.5 part |
| Ion-exchanged water | rest |

Image formation was carried out using an image fixing component R1, pigment inks K1, C1, M1 and Y1, and a supplementary liquid S1 prepared as described above.

The print head 18 for ejecting inks of each color and the print head 19 for applying the supplementary liquid used in the present example had recording density of 1200 dpi, and as a driving condition frequency of driving was 10 kHz. The amount of ejection of each dot from the head used was 4 pl.

First, after coating the transfer drum 1 with the image fixing component R1 to thickness of about 1 μm, pigment inks Y1, M1, C1 and K1 were sequentially applied with the ink-jet head 18 to form ink images on the transfer drum 1.

In the occasion, the pigment inks of each color on the transfer drum 1 were coagulated through reaction with the image fixing component R1, and the ink images 20 formed on the transfer drum 1 were good images without beading. Coagulation occurred instantaneously so that multiple applications of inks did not cause such phenomena as beading and bleeding, and the ink images 20 formed on the transfer drum 1 were confirmed to have high quality.

Next, the supplementary liquid S1 was ejected from the print head 19 for applying supplementary liquid, and applied to the high quality images, i.e. the ink images 20, on the transfer drum 1. Further, water which were main solvent were evaporated from the ink images 20 on the transfer drum 1 by air blasting from the air knife 22 in the next step. Then, in the transfer portion 6 the ink images 20 on the transfer drum 1 were transferred to the recording media 9 fed by the transportation rollers 24*a* and 24*b*, and thus prints were formed. Further, the prints were passed through the transportation/fixing rollers 29*a* and 29*b* at a heating temperature of 150° C. to form fixed images. The finally obtained color images were high quality images having good abrasion resistance that prevents ink stain even rubbed immediately after discharge. Thus, images without beading and bleeding, with ink images 20 on the transfer drum 1 thoroughly transferred to the recording medium, and having excellent abrasion resistance and water resistance were obtained. The transfer drum 1 did not have any residual inks, and the surface was easily cleaned. Further, high quality images could be formed even when the above-mentioned steps were repeated.

The Second Embodiment

In the present embodiment, the supplementary liquid applying portion 4 is arranged between the image fixing component coating portion 2 and the ink applying portion 3, so that the supplementary liquid 21 is applied to the transfer drum 1 before the inks of each color are applied to the transfer drum 1 in the ink applying portion 3.

Figure 2:
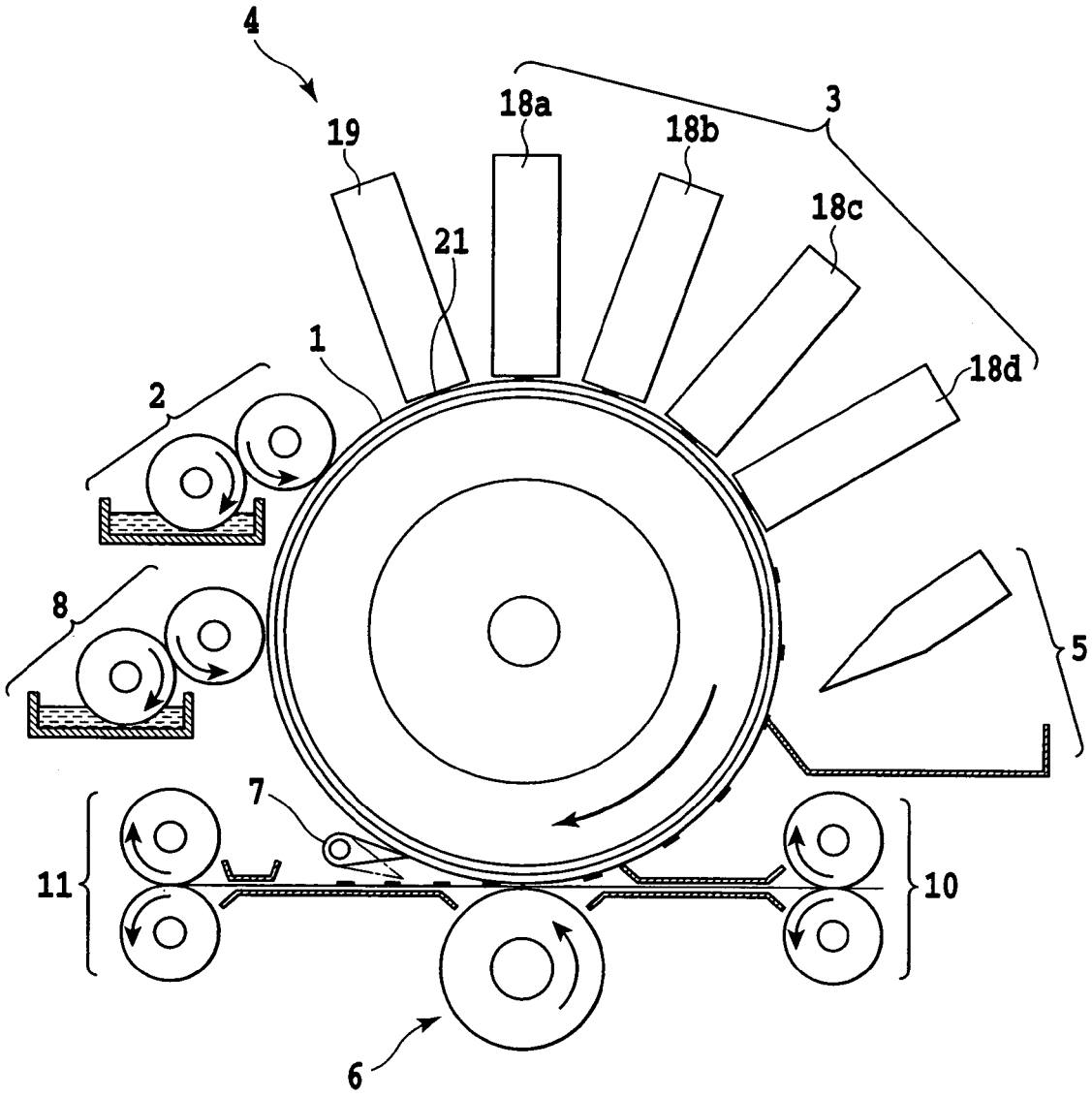
FIG. 2 is a schematic sectional view showing a conformation of the image forming portion of an ink-jet recording apparatus in accordance with an embodiment of the present invention.

FIG. 2 is a schematic sectional view of an image formation portion of an ink-jet recording apparatus related to an embodiment of the present invention.

In FIG. 2, since devices indicated by reference numerals 1-11 and parts conforming them and a control portion (unshown) are same as those in FIG. 1, description of them is abbreviated.

In the figure, the supplementary liquid applying portion 4 is arranged between the image fixing component coating portion 2 and the ink applying portion 3. Of the series of operations of the ink-jet recording apparatus of the present embodiment, those that are same as in the first embodiment will be abbreviated here, and only those characteristic to the present embodiment will be described below.

On receiving external image signals, an intermediate transfer body, i.e. a transfer drum 1, is rotated, and an image fixing component 16 is coated on the transfer drum 1 in the image fixing component coating portion 2. Next, a supplementary liquid is applied from a print head 19 for applying supplementary liquid 21 to the transfer drum 1, and then inks are ejected in an ink applying portion 3 to form ink images 20 on the transfer drum 1. Then, through the operations described with the first embodiment, the ink images 20 are transferred to recording media 9.

In the present embodiment, image fixing components, colored inks, and supplementary liquids that can be used in the first embodiment can also be used.

As described above, since an image fixing component 16 and a supplementary liquid 21 are used in the present embodiment as in the first embodiment, ink images 20 on the transfer drum 1 has high cohesive force. Therefore, when the ink images 20 are transferred to recording media 9, high quality images without beading and bleeding, having good abrasion resistance that prevents ink stain even if the images are rubbed immediately after output, can be formed.

An example of the present embodiment using examples of the above-mentioned image fixing components, colored inks, and supplementary liquids is described below.

EXAMPLE 2

In the present example, images were formed using the image fixing component R1, pigment inks K1, C1, M1 and Y1 and the supplementary liquid S1 described in Example 1 were used to form images.

The print head 18 for ejecting inks of each color and the print head 19 for applying the supplementary liquid used in the present example had recording density of 1200 dpi, and as a driving condition frequency of driving was 10 kHz. The amount of ejection of each dot from the head used was 4 pl.

Immediately after coating the transfer drum 1 with the image fixing component R1 to thickness of about 1 μm, the supplementary liquid S1 was ejected onto the transfer drum 1 from the print head 19 for applying supplementary liquid based on the logical sum signal of the binary format image signals of each ink. Then, pigment inks Y1, M1, C1 and K1 were ejected from the print heads 18*a*, 18*b*, 18*c* and 18*d* according to binary format signals of each color to form ink-jet images on the transfer drum 1. As a result, high quality coagulated ink images were formed on the transfer drum 1 like in the example 1. The image quality of the final prints is good without beading and bleeding, and abrasion resistance was improved due to existence of much resin layer on the surface of images after transfer.

The Third Embodiment

The present embodiment is characterized by that the supplementary liquid application means conforming the supplementary liquid applying portion is a roller.

Figure 3:
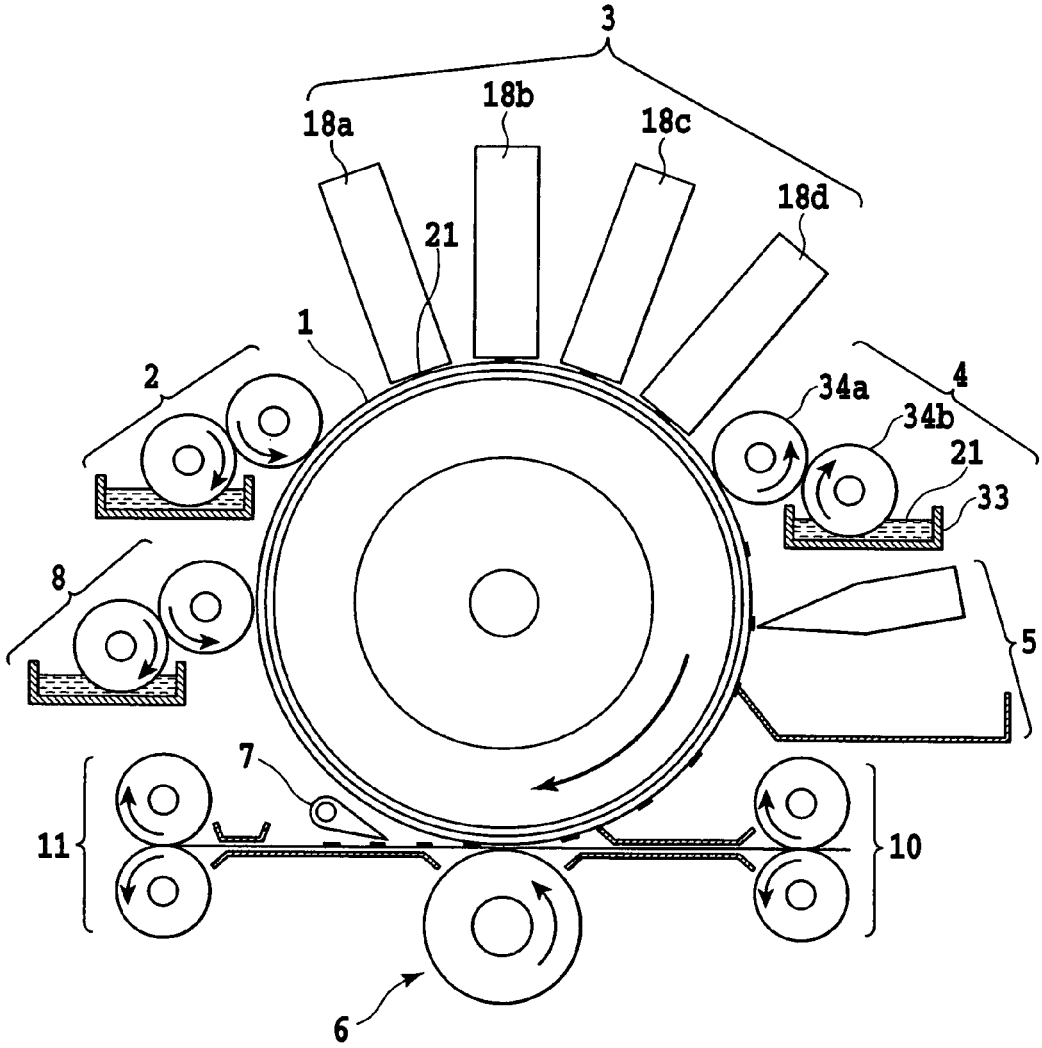
FIG. 3 is a schematic sectional view showing a conformation of the image forming portion of an ink-jet recording apparatus in accordance with an embodiment of the present invention.

FIG. 3 is a schematic sectional view showing conformation of an image forming portion of an ink-jet recording apparatus related to an embodiment of the present invention.

In FIG. 3, since devices indicated by reference numerals 1-3 and 5-11 and parts conforming the same and a control portion (unshown) are same as those in FIG. 1, description of them is abbreviated. Here, only the part characteristic to the present embodiment, the supplementary liquid applying portion 4, is explained.

In the figure, the supplementary liquid applying portion 4 comprises a supplementary liquid 21, a supplementary liquid storage part 33, and supplementary liquid supply rollers 34*a* and 34*b*.

The supplementary liquid applying portion 4 coats the supplementary liquid 21 in the supplementary liquid storage part 33 in the whole image formable region on the transfer drum 1 including the ink images 20.

In the figure, the supplementary liquid applying portion 4 is positioned at down flow side of the ink applying portion 3 on the transfer drum 1. The supplementary liquid 21 is coated on the ink images 20 formed with two supplementary liquid supply rollers 34*a* and 34*b* on the transfer drum 1. In this occasion, the supplementary liquid supply roller 34*a* can be abutted to and detached from the transfer drum 1 corresponding to image signals sent from the control portion. Though highly wettable materials are preferable as the supplementary liquid supply rollers 34*a* and 34*b*, porous or surface concavo-convex materials such as materials like gravure rolls can also be used. The supplementary liquid applying portion 4 is so conformed that it can be abutted to and detached from the transfer drum 1 under the control of an unshown abutting/detaching control device.

Although the supplementary liquid applying portion 4 is positioned at down flow side of the ink applying portion 3 on the transfer drum 1 in the present embodiment, it may also be positioned at up flow side of the ink applying portion 3.

Of the series of operations of the ink-jet recording apparatus of the present embodiment, those that are same as in the first embodiment will be abbreviated here, and only those characteristic to the present embodiment will be described below.

When ink images 20 are formed in accordance with external image signals on the transfer drum 1 by means of the image fixing component coating portion 2 and the ink applying portion 3, the supplementary liquid supply roller 34*a* is abutted to the transfer drum 1. Then, rotation of the supplementary liquid supply roller 34*b* allows the supplementary liquid 21 to be coated on the supplementary liquid supply roller 34*a* through the supplementary liquid supply roller 34*b*, and then the supplementary liquid 21 is coated on the ink image 20 formed on the transfer drum 1. After the supplementary liquid 21 is coated on the ink images 20 in one rotation of the transfer drum 1, the supplementary liquid supply roller 34*a* is detached from the transfer drum 1. Then, the ink image 20 is transferred to recording media 9 through the operations described in the first embodiment.

In the present embodiment, the image fixing components, the colored inks and the supplementary liquids usable in the first embodiment can also be used.

As described above, since an image fixing component 16 and a supplementary liquid 21 are used in the present embodiment as in the first embodiment, ink images 20 on the transfer drum 1 has high cohesive force. Therefore, when the ink images 20 are transferred to recording media 9, high quality images without beading and bleeding, having good abrasion resistance that prevents ink stain even if the images are rubbed immediately after output, can be formed.

An example of the present embodiment using examples of the above-mentioned image fixing components, colored inks, and supplementary liquids is described below.

EXAMPLE 3

In the present example, images were formed using the image fixing component R1, pigment inks K1, C1, M1 and Y1 described in example 1 and the supplementary liquid S2 described below were used to form images.

(Preparation of a Supplementary Liquid S2)

Ingredients in the composition ratio shown below were mixed to prepare a supplementary liquid S2.

| | |
|---|---|
| Hexylene glycol | 15.0 parts |
| Ethylene glycol | 15.0 parts |
| Polyvinylpyrrolidone (K-90; molecular weight 360000) | 10.0 parts |
| Acetylenol EH (from Kawaken Fine Chemicals) | 0.5 part |
| Ion-exchanged water | rest |

The print head 18 for ejecting inks of each color used in the present example had recording density of 1200 dpi, and as a driving condition frequency of driving was 10 kHz. The amount of ejection of each dot from the head used was 4 pl.

After coating the transfer drum 1 with the image fixing component R1 to thickness of about 1 μm, pigment inks Y1, M1, C1 and K1 were ejected from the print heads 18*a*, 18*b*, 18*c* and 18*d* according to external image signals, and ink images 20 were obtained on the transfer drum 1.

Next, the supplementary liquid S2 was applied to whole area of the transfer drum 1 by means of the supplementary liquid applying portion 4. Then, most of the main solvent, i.e. water, on the transfer drum 1 was evaporated by air blowing from the air knife 22 in the next step. After that, the whole image region including the ink images 20 formed on the transfer drum 1 was transferred to the recording media 9 fed by the transportation rollers 24*a* and 24*b* in the transfer portion 6, and thus prints were formed. Further, the prints were passed through the transportation/fixing rollers 29*a* and 29*b* at a heating temperature of 150° C. to form fixed images. The finally obtained color images were high quality images having good abrasion resistance that prevented ink stain even rubbed immediately after output. Thus, images without beading and bleeding, with ink images 20 on the transfer drum 1 thoroughly transferred to the recording medium, and having excellent abrasion resistance and water resistance, were obtained. Further, images with gloss all over, in spite of irregularity of the surface of the recording media 9, were formed.

The Fourth Embodiment

The present embodiment is characterized by that a supplementary liquid application means conforming the supplementary liquid applying portion is arranged at down flow side of the ink treatment portion 5.

Figure 5:
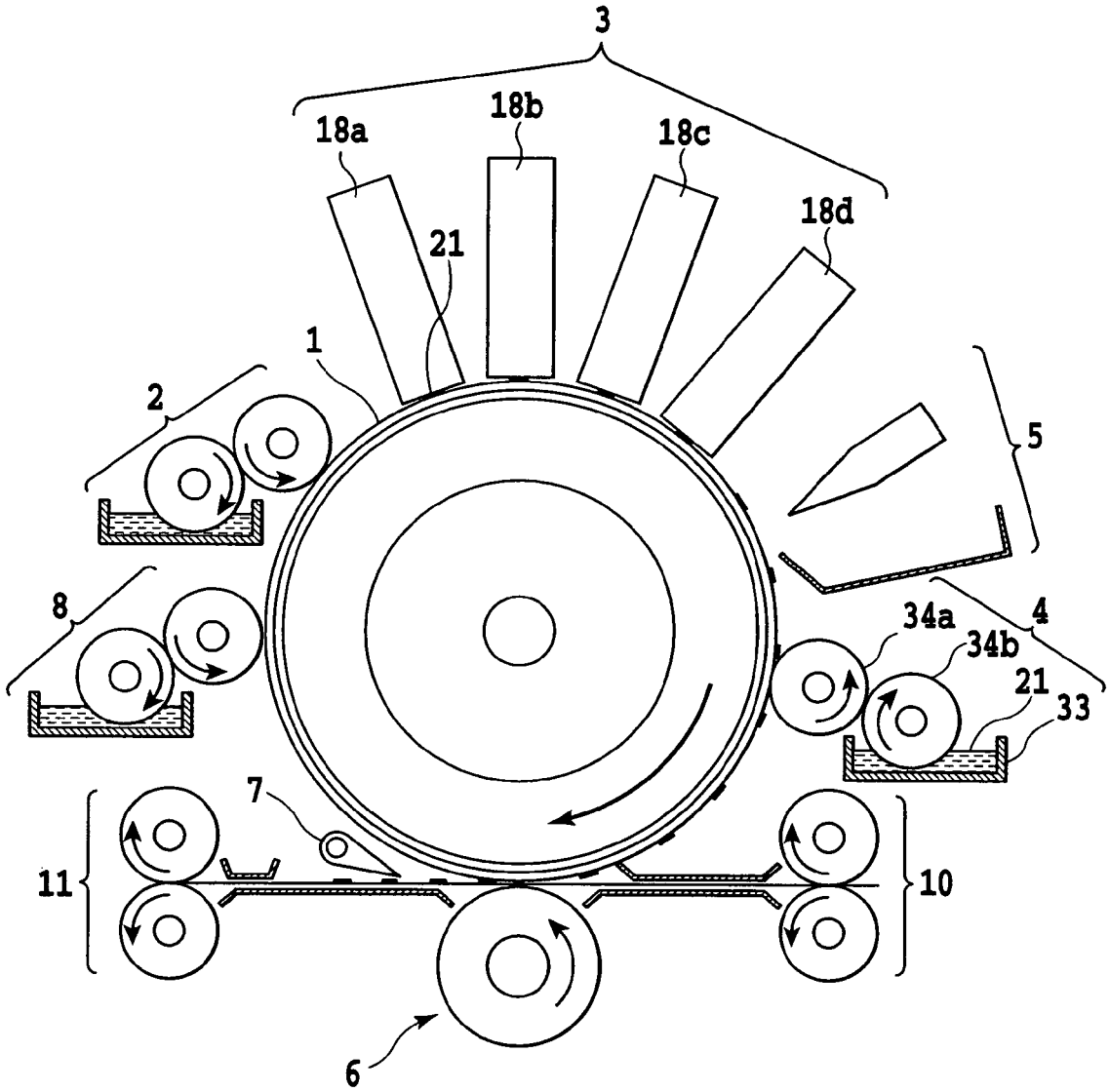
FIG. 5 is a schematic sectional view showing a conformation of the image forming portion of an ink-jet recording apparatus in accordance with an embodiment of the present invention.

FIG. 5 is a schematic sectional view showing a conformation of the image forming portion of an ink-jet recording apparatus in accordance with an embodiment of the present invention. In FIG. 5, since devices indicated by reference numerals 1-11 and parts conforming them, and a control portion (unshown) are same as those in FIG. 1, description of them is abbreviated.

In the same figure, the supplementary liquid applying portion 4 is positioned at down flow side of the ink image treatment portion 5 on the transfer drum 1. The supplementary liquid 21 is coated on the ink images 20 formed with two supplementary liquid supply rollers 34*a* and 34*b* on the transfer drum 1. In this occasion, the supplementary liquid supply roller 34*a* can be abutted to and detached from the transfer drum 1 corresponding to image signals sent from the control portion. The supplementary liquid applying portion 4 is so conformed that it can be abutted to and detached from the transfer drum 1 under the control of an unshown abutting/detaching control device.

Of the series of operations of the ink-jet recording apparatus of the present embodiment, those that are same as in the first embodiment will be abbreviated here, and only those characteristic to the present embodiment will be described below.

The ink images 20 are formed in accordance with external image signals on the transfer drum 1 by means of the image fixing component coating portion 2 and the ink applying portion 3. Next, most of the main solvent, i.e. water, on the transfer drum 1 is evaporated by air blowing from the air knife 22 of the ink image treatment portion. Next, the supplementary liquid supply roller 34*a* is abutted to the transfer drum 1. Then, rotation of the supplementary liquid supply roller 34*b* allows the supplementary liquid 21 to be coated on the supplementary liquid supply roller 34*a* through the supplementary liquid supply roller 34*b*, and then the supplementary liquid 21 is coated on the ink image 20 formed on the transfer drum 1. After the supplementary liquid 21 is coated on the ink image 20 in one rotation of the transfer drum 1, the supplementary liquid supply roller 34*a* is detached from the transfer drum 1. Then, the ink image 20 is transferred to recording media 9 through the operations described in the first embodiment.

In the present embodiment, the image fixing components, the colored inks and the supplementary liquids usable in the first embodiment can also be used.

As described above, since an image fixing component 16 is used in the present embodiment as in the first embodiment, ink images 20 on the transfer drum 1 has high cohesive force. Therefore, when the ink images 20 are transferred to recording media 9, high quality images without beading and bleeding, having good abrasion resistance that prevents ink stain even if the images are rubbed immediately after output, can be formed.

An example of the present embodiment using examples of the above-mentioned image fixing components, colored inks, and supplementary liquids is described below.

EXAMPLE 4

In the present example, images were formed using the image fixing component R1, pigment inks K1, C1, M1 and Y1 described in example 1 and the supplementary liquid S2 described below were used to form images.

(Preparation of Supplementary Liquid S2)

Ingredients with ratios shown below were mixed to form a supplementary liquid S2.

| | |
|---|---|
| Hexylene glycol | 15.0 parts |
| Ethylene glycol | 15.0 parts |
| Polyvinylpyrrolidone (K-90; molecular weight 360000) | 10.0 parts |
| Acetylenol EH (from Kawaken Fine Chemicals) | 0.5 part |
| Deionized water | rest |

The print head 18 for ejecting inks of each color used in the present example had recording density of 1200 dpi, and as the driving condition, frequency of driving was 10 kHz. The amount of ejection of each dot from the head used was 4 pl.

First, after coating the transfer drum 1 with the image fixing component R1 to thickness of about 1 μm, pigment inks Y1, M1, C1 and K1 were sequentially ejected from the print heads 18*a*, 18*b*, 18*c*, 18*d* according to external image signals to form ink images on the transfer drum 1.

Next, the main solvent, i.e. water, on the transfer drum 1 was evaporated by air blasting from the air knife 22 in the ink image treatment portion. Then, the supplementary liquid S2 was applied all over the transfer drum 1 by the supplementary liquid applying portion 4. In the transfer portion 6, the whole image region including the ink images 20 formed on the transfer drum 1 was transferred to the recording media 9 fed by the transportation rollers 24*a* and 24*b*, and thus prints were formed. Further, the prints were passed through the transportation/fixing rollers 29*a* and 29*b* at a heating temperature of 150° C. to form fixed images. The finally obtained color images were high quality images having good abrasion resistance that prevented ink stain even rubbed immediately after output. Thus, images without beading and bleeding, with ink images 20 on the transfer drum 1 thoroughly transferred to the recording medium, and having excellent abrasion resistance and water resistance, were obtained.

In the present embodiment, the supplementary liquid 21 is applied after drying to implement transfer. Further, acceleration of drying can be controlled by means of re-drying before transfer. This has a further advantage that high speed recording can be implemented.

The Fifth Embodiment

In the first to forth embodiments, the supplementary liquid applying portion is arranged at down side of the image fixing component applying portion. However, the supplementary liquid applying portion may be arranged at the up side of the image fixing component applying portion.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application Nos. 2003-391485 filed Nov. 20, 2003 and 2004-307229 filed Oct. 21, 2004 which are hereby incorporated by reference herein.

What is claimed is:

1. An ink-jet recording method comprising the steps of:

applying a first material that reduces flowability of ink having colorants, to an intermediate transfer body;

forming an ink image on said intermediate transfer body by applying said ink from a print head to said intermediate transfer body to which said first material has been applied;

transferring said ink image formed on said intermediate transfer body to a recording medium; and applying a second material to improve abrasion resistance of images on said recording medium to said intermediate transfer body before said transferring step.

2. An ink-jet recording method comprising the steps of:

applying a first material for making colorants of ink coagulate, to an intermediate transfer body;

forming an ink image on said intermediate transfer body by applying said ink from a print head to said intermediate transfer body to which said first material has been applied;

transferring said ink image formed on said intermediate transfer body to a recording medium; and applying a second material having resin to said intermediate transfer body before said transferring step.

3. An ink-jet recording method as claimed in claim 2, wherein said first material is a liquid at least having a metal salt.

4. An ink-jet recording method as claimed in claim 2, wherein said second material is a liquid at least having a water-soluble resin.

5. An ink-jet recording method as claimed in claim 2, wherein said colorant is a pigment.

6. An ink-jet recording method as claimed in claim 2, further comprising a drying step of drying said ink image prior to said transferring step.

7. An ink-jet recording method as claimed in claim 2, further comprising a cleaning step of cleaning said intermediate transfer body after said transferring step.

8. An ink-jet recording method as claimed in claim 2, wherein a surface of said intermediate transfer body includes a compound at least having fluorine or silicone.

9. An ink-jet recording method as claimed in claim 2, wherein said second material applying step applies said second material to said intermediate transfer body by means of a roller or a print head.

10. An ink-jet recording method as claimed in claim 2, wherein said second material applying step is performed after said ink applying step.

11. An ink-jet recording method as claimed in claim 2, wherein said second material applying step is performed after said first material applying step and before said ink applying step.

12. An ink-jet recording apparatus comprising:

first application means for applying a first material that reduces flowability of ink having colorants, to an intermediate transfer body;

formation means for forming an ink image on said intermediate transfer body by applying said ink from a print head to said intermediate transfer body to which said first material has been applied;

transfer means for transferring said ink image formed on said intermediate transfer body to a recording medium; and second application means for applying a second material to improve abrasion resistance of images on said recording media medium to said intermediate transfer body before the ink image is transferred by said transfer means.

13. An ink-jet recording apparatus comprising:

a first application portion that applies a first material for rendering colorants of ink coagulate, to an intermediate transfer body;

a formation portion that forms an ink image on said intermediate transfer body by applying said ink from a print head to said intermediate transfer body to which said first material has been applied;

a transfer portion that transfers said ink image formed on said intermediate transfer body to a recording medium; and a second application portion that applies a second material having resin to said intermediate transfer body before the ink image is transferred in said transfer portion.

* * * * *

UNITED STATES PATENT AND TRADEMARK OFFICE

CERTIFICATE OF CORRECTION

PATENT NO. : 7,281,790 B2
APPLICATION NO. : 10/986911
DATED : October 16, 2007
INVENTOR(S) : Akihiro Mouri et al.

It is certified that error appears in the above-identified patent and that said Letters Patent is hereby corrected as shown below:

ON THE TITLE PAGE:
At Item (57), ABSTRACT,
Line 2, “image,” should read --images--.
Line 7, “example” should read --example,--.
Line 9, “corresponding” should read --corresponding to--.

COLUMN 1:
Line 12, “to an” should read --to a--.
Line 23, “etc.” should read --etc.,--.

COLUMN 2:
Line 16, “port” should read --ports--.
Line 53, “remove” should read --removal--.

COLUMN 3:
Line 18, “is” should read --are--.
Line 27, “allow” should read --allows--.
Line 31, “occurs” should read --occurs,--.
Line 38, “transferred” should read --transferred to--.
Line 40, “irregulars” should read --irregular--.

COLUMN 6:
Line 40, “etc.” should read --etc.,--.
Line 43, “invention,” should read --invention, to--.

COLUMN 7:
Line 26, “i.e.” should read --i.e.,-- and “applied” should read --applied with--.
Line 38, “Towards circumference” should read --Towards the circumference--.
Line 53, “i.e.” should read --i.e.,--.

COLUMN 8:
Line 12, “pass” should read --bus--.
Line 13, “i.e.” should read --i.e.,--.
Line 15, “detected” should read --detected by--.
Line 53, “view point” should read --viewpoint--.

UNITED STATES PATENT AND TRADEMARK OFFICE

CERTIFICATE OF CORRECTION

PATENT NO. : 7,281,790 B2
APPLICATION NO. : 10/986911
DATED : October 16, 2007
INVENTOR(S) : Akihiro Mouri et al.

It is certified that error appears in the above-identified patent and that said Letters Patent is hereby corrected as shown below:

COLUMN 9:
Line 43, “a ink-jet” should read --an ink-jet--.

COLUMN 10:
Line 3, “to occur” should read --from occurring--.
Line 26, “butylenes” should read --butylene--.

COLUMN 11:
Line 40, “comprising” should read --comprises--.
Line 50, “row of” should read --row of a--.

COLUMN 12:
Line 6, “from” should read --from the--.
Line 12, “on” should read --on the--.
Line 13, “the” should be deleted.
Line 17, “revere” should read --reverse--.
Line 19, “i.e.” should read --i.e.,--.

COLUMN 13:
Line 17, “i.e.” should read --i.e.,--.
Line 31, “e.g.” should read --e.g.,--.

COLUMN 14:
Line 34, “treatment” should read --treatment.--.
Line 59, “having” should read --having a--.
Line 67, “i.e.” should read --i.e.,--.

COLUMN 15:
Line 56, “i.e.” should read --i.e.,--.
Line 61, “i.e.” should read --i.e.,--.

COLUMN 16:
Line 27, “a,β-ethylenic” should read --α,β-ethylenic--.

UNITED STATES PATENT AND TRADEMARK OFFICE

CERTIFICATE OF CORRECTION

PATENT NO. : 7,281,790 B2
APPLICATION NO. : 10/986911
DATED : October 16, 2007
INVENTOR(S) : Akihiro Mouri et al.

It is certified that error appears in the above-identified patent and that said Letters Patent is hereby corrected as shown below:

COLUMN 17:
Line 39, “at” should read --at a--.
Line 49, “in” should read --into--.
Line 61, “is” should read --are--.

COLUMN 18:
Line 17, “portion 27,” should read --portion 7,--.
Line 27, “guides 18a” should read --guides 28a--.
Line 40, “etc.” should read --etc.,--.
Line 62, “operation” should read --operations--.

COLUMN 19:
Line 32, “the occasion” should read --this occasion--.
Line 44, “i.e.” should read --i.e.,--.
Line 45, “applied” should read --applied with--.
Line 52, “i.e.” should read --i.e.,--.
Line 53, “i.e.” should read --i.e.,--.

COLUMN 20:
Line 21, “i.e.” should read --i.e.,--.
Line 41, “example” should read --examples--.
Line 47, “blow,” should read --below,--.
Line 48, “noticed.” should read --noted.--.

COLUMN 21:
Line 4, “parts” should read --part--.
Line 28, “Acethylenol EH” should read --Acetylenol EH--.
Line 64, “Acethylenol EH” should read --Acetylenol EH--.

COLUMN 22:
Line 28, “the occasion,” should read --this occasion--.
Line 38, “i.e.” should read --i.e.,--.
Line 29, “were” should read --was the--.
Line 40, “were” should read --was--.
Line 49, “even” should read --even when--.

UNITED STATES PATENT AND TRADEMARK OFFICE

CERTIFICATE OF CORRECTION

PATENT NO. : 7,281,790 B2
APPLICATION NO. : 10/986911
DATED : October 16, 2007
INVENTOR(S) : Akihiro Mouri et al.

It is certified that error appears in the above-identified patent and that said Letters Patent is hereby corrected as shown below:

COLUMN 23:
Line 17, "i.e." should read --i.e.,--.
Line 33, "has" should read --have--.

COLUMN 25:
Line 2, "has" should read --have--.
Line 37, "to" should read --to the--.
Line 41, "i.e." should read --i.e.,--.
Line 51, "even" should read --even when--.

COLUMN 26:
Line 26, "i.e." should read --i.e.,--.
Line 47, "has" should read --have--.

COLUMN 27:
Line 19, "i.e." should read --i.e.,--.
Line 32, "even" should read --even when--.

COLUMN 28:
Line 65, "media" should be deleted.

Signed and Sealed this

Twenty-ninth Day of September, 2009

David J. Kappos

David J. Kappos
*Director of the United States Patent and Trademark Office*